US008851694B2

(12) United States Patent
Harada

(10) Patent No.: US 8,851,694 B2
(45) Date of Patent: Oct. 7, 2014

(54) SEMICONDUCTOR LIGHT SOURCE APPARATUS

(75) Inventor: Mitsunori Harada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 394 days.

(21) Appl. No.: 13/414,702

(22) Filed: Mar. 7, 2012

(65) Prior Publication Data

US 2012/0230011 A1 Sep. 13, 2012

(30) Foreign Application Priority Data

Mar. 7, 2011 (JP) ..... 2011-049362

(51) Int. Cl.

| | |
|---|---|
| ***F21V 9/16*** | (2006.01) |
| ***F21S 8/10*** | (2006.01) |
| *F21W 131/103* | (2006.01) |
| *F21Y 101/02* | (2006.01) |
| *F21W 131/406* | (2006.01) |

(52) U.S. Cl.

CPC ..... *F21V 9/16* (2013.01); *F21W 2131/103* (2013.01); *F21S 48/1145* (2013.01); *F21Y 2101/025* (2013.01); *F21W 2131/406* (2013.01)

USPC ..... 362/84; 362/259

(58) Field of Classification Search

None

See application file for complete search history.

(56) References Cited

U.S. PATENT DOCUMENTS

| | | | | |
|---|---|---|---|---|
| 7,040,774 | B2 * | 5/2006 | Beeson et al. | 362/84 |
| 7,497,581 | B2 * | 3/2009 | Beeson et al. | 362/84 |
| 2005/0239227 | A1 | 10/2005 | Aanegola et al. | |
| 2006/0198418 | A1 | 9/2006 | Hama et al. | |
| 2010/0172388 | A1 | 7/2010 | Hwang et al. | |
| 2011/0280039 | A1 * | 11/2011 | Kishimoto | 362/554 |
| 2011/0310587 | A1 * | 12/2011 | Edmond et al. | 362/84 |

FOREIGN PATENT DOCUMENTS

| | | | |
|---|---|---|---|
| JP | 2005-537651 | A | 12/2005 |
| JP | 2009-231368 | A | 10/2009 |
| JP | 4375270 | B2 | 12/2009 |

* cited by examiner

*Primary Examiner* — Britt D Hanley

(74) *Attorney, Agent, or Firm* — Kenealy Vaidya LLP

(57) ABSTRACT

A semiconductor light source apparatus can include a clad layer, a phosphor layer surrounded by the clad layer and a laser diode emitting a laser light. The phosphor layer can include a cavity having an opening for receiving the laser light, a phosphor material and a light-emitting surface of the apparatus. The laser light entering into the cavity can repeatedly reflect on an inner surface of the phosphor layer many times, each and every time most of the laser light entering into the phosphor layer. The laser light can be efficiently wavelength-converted by the phosphor material and the wavelength converted light can be emitted from the light-emitting surface having various shapes exposed from the clad layer. Therefore, the disclosed subject matter can include providing semiconductor light source apparatuses having a high light-emitting efficiency and high light-emitting density such that the devices can be used for a headlight, general lighting, etc.

20 Claims, 18 Drawing Sheets

SEMICONDUCTOR LIGHT SOURCE APPARATUS

This application claims the priority benefit under 35 U.S.C. §119 of Japanese Patent Application No. 2011-049362 filed on Mar. 7, 2011, which is hereby incorporated in its entirety by reference.

BACKGROUND

1. Field

The presently disclosed subject matter relates to a semiconductor light source apparatus including a phosphor layer for wavelength conversion, and more particularly to a high power semiconductor light source apparatus using a laser light as an excitation light, which can improve a light-emitting efficiency by efficiently combining the laser light into the phosphor layer, and which can also emit various color lights including a natural light having a large amount of light intensity in order to be able to be used for a laser headlight, general lighting, a stage light, a street light, etc.

2. Description of the Related Art

Semiconductor light source apparatuses that emit various color lights including white light by combining a phosphor with a semiconductor light-emitting device such as an LED have been used for business machines, home electronics, etc. Recently, because brightness of the semiconductor light source apparatuses have improved, a range of application for the semiconductor light source apparatuses has expanded to fields such as general lighting, street lighting, vehicle headlights, etc.

In accordance with one method for improving the brightness of the semiconductor light source apparatuses including the phosphor, an excitation intensity of the phosphor can be enhanced by employing a laser light as an excitation light for the phosphor because the laser light has a high light-emitting intensity in general. Therefore, various semiconductor light source apparatuses having a high light-emitting efficiency and a high color rendering index using the laser light as the excitation light have been developed.

A dome-shaped semiconductor light source apparatus using a phosphor layer and a laser light is disclosed in Patent Document No. 1 (Japanese Patent Application Laid Open JP2005-537651). FIG. 16 is a schematic cross-sectional view showing a first conventional semiconductor light source apparatus using a phosphor and a laser light, which is formed in a dome shape and which is disclosed in Patent Document No. 1.

The first conventional semiconductor light source apparatus 90 includes: a sub mount substrate 92; a laser diode 91 emitting a laser light as an excitation light and mounted on the sub mount substrate 92; a reflective board 93 for mounting the sub mount substrate 92 along with the laser diode 91 thereon; a lens 95 formed in a dome shape and located on the reflective board 93 so as to cover the sub mount substrate 92 on which the laser diode 91 is mounted thereon; a phosphor 94 disposed underneath an inner surface of the lens 95 and formed in a uniform thickness; and a transparent resin 96 disposed between the lens 95 and the reflective board 93 so as to encapsulate the laser diode 91 along with the sub mount substrate 92.

Accordingly, the conventional light source apparatus 90 may emit a wavelength converted light by using a laser light emitted from the laser diode 91 to excite the phosphor 94. In this case, although a returning light directed toward the reflective board 93 may occur because a part of the laser light is reflected by the phosphor 94, the returning light may be again returned toward the lens 95 by reflecting the light on the reflective board 93. Hence, the conventional light source apparatus 90 may reduce the amount of light absorbed in the transparent resin 96 and the like, and therefore may improve a light-emitting efficiency.

However, it may be difficult for the conventional apparatus 90 to efficiently use the laser light to excite the phosphor 94 because the laser light may be subject to a back-reflection under the phosphor 94. In addition, it may be difficult for the conventional apparatus 90 to improve a light-emitting density due to a large light-emitting surface, even though the light returning directed toward the reflective board 93 may be repeatedly returned toward the lens 95. Therefore, the semiconductor light-emitting source apparatus disclosed in Patent Document No. 1 may not be a match for a usage such as a vehicle headlight, in which a light source having a high light-emitting density is desired to provide a light distribution pattern that conforms to a standard for a vehicle headlight.

To avoid such a problem, a semiconductor light source apparatus using a light guide in addition to a laser light and a phosphor is disclosed in Patent Document No. 2 (Japanese Patent No. 4,375,270). FIG. 17*a* is a schematic structural view showing a second conventional semiconductor light source apparatus using a light guide in addition to a laser light and a phosphor, and FIG. 17*b* is a close up cross-sectional view showing an exemplary light-emitting portion of the semiconductor light source apparatus shown in FIG. 17*a*, which are disclosed in Patent Document No. 2.

The second conventional semiconductor light source apparatus 80 includes: a laser light source 81 emitting a laser light as an excitation light; a light guide 82 transmitting the laser light; a phosphor 84; and a light-emitting portion 83 connecting the light guide 82 to the phosphor 84 and emitting a wavelength converted light by absorbing and exciting the laser light with the phosphor 84. In this case, because the laser light may be emitted into the phosphor 84 from the light guide 82 formed in a thin circular shape, the semiconductor light source apparatus 80 may enhance a light-emitting density of the wavelength converted light.

However, the laser light emitted from the light guide 82 may also be subject to a back-reflection under the phosphor 84, such that a part of the laser light getting to the phosphor 84 may return toward the light guide 82. Accordingly, a light-emitting efficiency of the semiconductor light source apparatus 80 may not necessarily be high. In addition, because a plurality of light guides 82 may be required to be employed for the above-described usage such as a headlight, a lighting unit using the semiconductor light-emitting source apparatus disclosed in Patent Document No. 1 may become a complex structure in some cases.

To avoid the problem of the back-reflection, a semiconductor light source apparatus using a laser light and a phosphor, in which a reflection ratio of a laser light is reduced on a surface of a light guide including a phosphor, is disclosed in Patent Document No. 3 (Japanese Patent Application Laid Open JP 2009-231368). FIG. 18 is a schematic horizontal cross-sectional view depicting a third semiconductor light source apparatus using a laser light and a phosphor, which is disclosed in Patent Document No. 3.

The third conventional light source apparatus 70 includes: a semiconductor laser chip 71 emitting a laser light as an excitation light; a supporting board 72 including a concave portion 72*a* with laser chip 71 attached thereto so that a light-emitting surface of the laser chip 71 is exposed to a cavity 73 from the concave portion 72*a*; and a light guide 74 having an incident surface 74*a* and a light-emitting surface 74*b* being inserted in the supporting board 72 and including a phosphor 75 for wavelength-converting the laser light, and wherein the incident surface 74*a* is configured with a curved surface such that an incident angle of the laser light is within a predetermined range including Brewster's angle.

Thereby, p-wave of the laser light may enter into the light guide 74 without a mirror reflection, and a reflection ratio of the laser light on the incident surface 74*a* of the light guide 74 may be reduced. Accordingly, the conventional light source apparatus 70 may improve a light-emitting efficiency. However, light entering into the light guide 74 may spread in the light guide 74 due to a light refraction as shown by arrows in FIG. 18, and then may be emitted from the light-emitting surface 74*b* as a wavelength converted light after it is wavelength-converted by the phosphor 75 dispersed in the light guide 74.

Consequently, the semiconductor light source apparatus 70 may not improve a density of the wavelength converted light because the wavelength converted light emitted from the light source apparatus 70 may be diffused from the light-emitting surface 74*b*. Thus, the semiconductor light source apparatus disclosed in Patent Document No. 3 may not also be a match for the above-described usage such as for a headlight, in which a light source having a high light-emitting density is desired to provide a light distribution pattern such that conforms to a standard for a vehicle headlight.

The above-referenced Patent Documents are listed below and are hereby incorporated with their English abstracts in their entireties.

1. Patent document No. 1: Japanese Patent Application Laid Open JP2005-537651
2. Patent document No. 2: Japanese Patent No. 4,375,270
3. Patent Document No. 3: Japanese Patent Application Laid Open JP 2009-231368

The disclosed subject matter has been devised to consider the above and other problems, characteristics and features. Thus, exemplary embodiments of the disclosed subject matter can include semiconductor light source apparatuses which can emit a natural light having a high light-emitting efficiency and a high light-emitting density such that can be used as a light source for a vehicle headlight, a projector and the like, and which can improve a light-emitting efficiency by preventing the above-described back-reflection and/or by promoting effective use of the back-reflection.

In addition, exemplary embodiments of the disclosed subject matter can include semiconductor light source apparatuses which can emit various color lights having a high light-emitting efficiency such that the devices can be used as various light sources for general lighting, stage lighting, etc. In this case, the semiconductor light source apparatuses can select a structure for a phosphor layer that converts a laser light used as an excitation light into wavelength converted light having various light distributions, so that the semiconductor light source apparatuses can easily select each of a light-emitting density and a light distribution such as a diffused light, a focused light and the like in accordance with a usage of the semiconductor light source apparatus.

SUMMARY

The presently disclosed subject matter has been devised in view of the above and other characteristics, desires, and problems in the conventional art. An aspect of the disclosed subject matter can include semiconductor light source apparatuses which can emit a natural light having a high light-emitting efficiency and a high light-emitting density such that can be used as a light source for a vehicle headlight, a projector and the like, and which can improve a conventional light-emitting efficiency by preventing a back-reflection of a laser light. Another aspect of the disclosed subject matter can include providing semiconductor light source apparatuses having a high light-emitting efficiency, which can improve a light-emitting efficiency by promoting effective use of the back-reflection with a relatively small phosphor layer. Another aspect of the disclosed subject matter can include providing semiconductor light source apparatuses, which can provide various light distribution patterns such as a wide range, a radial fashion and the like, and which can be used for various lighting units such as general lighting, a street light, etc.

According to one aspect of the disclosed subject matter, a semiconductor light source apparatus can include: a phosphor layer having a cavity, a top edge located between a top surface and an outer surface and a bottom edge located between a bottom surface and the outer surface, and including at least one phosphor material that converts at least one energy of blue light and ultraviolet light into light having a wavelength, the top surface including at least one of a planar surface, a convex surface and a concave surface, the bottom surface formed in a ring shape, the cavity including an inner surface of the phosphor layer, an opening surrounded by the bottom surface and an end located opposite the opening, and the cavity configured to narrow from the opening toward the end thereof; a clad layer formed in a ring shape, an inner surface thereof including a reflective material and being located adjacent the outer surface of the phosphor layer, a first opening thereof located adjacent the top edge of the phosphor layer, and a second opening thereof located adjacent the bottom edge of the phosphor layer; and a semiconductor laser diode emitting at least one laser light of the blue light and the ultraviolet light, an optical axis thereof intersecting with the inner surface of the phosphor layer so that the laser light enters into the phosphor layer, wherein the inner surface of the phosphor layer is configured to again receive a laser light not entering into the phosphor layer toward the end of the phosphor layer than a position of the inner surface where the laser light does not enter into the phosphor layer.

In the above-described exemplary light source apparatus, each of the top edge and the bottom edge of the phosphor layer can be formed in a substantially same shape having a central point, and the outer surface of the phosphor layer can be substantially parallel to a central axis connecting the central point of the top edge to the central point of the bottom edge of the phosphor layer in order to enhance a light-emitting density. In addition, each of the top edge and the bottom edge of the phosphor layer can also be formed in a substantially similarity shape having a central point, and the similarity shape shrinks from the bottom edge of the phosphor layer toward the top edge of the phosphor lay along a central axis connecting the central point of the top edge to the central point of the bottom edge of the phosphor layer in order to further enhance a light-emitting density.

Moreover, the semiconductor laser diode can be a blue light-emitting device and the phosphor layer can be one of a yellow glass phosphor layer and a yellow phosphor ceramic in order for the light source apparatus to emit white light having a high light intensity similar to a natural light. The semiconductor light source apparatus can further include an optical lens having an optical axis located adjacent the top surface of the phosphor layer, wherein the optical axis of the optical lens corresponds to the substantially central axis connecting the central point of the top edge to the central point of the bottom edge of the phosphor layer, so as to be used as a light source for a vehicle headlight, a projector and the like.

According to the above-described exemplary semiconductor light source apparatuses, the laser light entering into the cavity can repeat reflections on the inner surface of the phosphor layer many a time, each and every time most of the laser light can enter into the phosphor layer having the above-described structures. The laser light can be wavelength converted in the phosphor layer and a focused wavelength converted light can be emitted from a small light-emitting surface. Therefore, the disclosed subject matter can include providing a semiconductor light source apparatus having a high light-emitting efficiency and a high light-emitting density. The semiconductor light source apparatus can emit a substantially natural light having a high light-emitting density such that can be used as a light source for a vehicle headlight and the like, and which can improve a light-emitting efficiency by preventing a back-reflection toward the laser diode.

According to another aspect of the disclosed subject matter, the semiconductor light source apparatus can include: a phosphor layer having a bottom edge, a cavity and a top edge located between a top surface and an outer surface, and including at least one phosphor material that converts at least one energy of blue light and ultraviolet light into light having a wavelength, the top surface including at least one of a planar surface, a convex surface and a concave surface, the bottom edge formed in a ring shape and being located between the outer surface and an inner surface of the phosphor layer, the cavity including the inner surface of the phosphor layer, an opening surrounded by the bottom edge and a concave surface located opposite the opening, the concave surface of the cavity having an outer end and a central axis formed in a rotational plane with respect to the central axis and connecting to the inner surface of the phosphor layer, and therefore the inner surface of the phosphor layer forming the concave surface of the cavity so as to project from the top end of the concave surface, and the cavity configured to narrow from the opening toward the top end of the concave surface along the central axis of the concave surface of the cavity; a clad layer formed in a ring shape, an inner surface thereof including a reflective material and being located adjacent the outer surface of the phosphor layer, a first opening thereof adjacent the top edge of the phosphor layer, and a second opening thereof located adjacent the bottom edge of the phosphor layer; and a semiconductor laser diode emitting at least one laser light of the blue light and the ultraviolet light, an optical axis thereof corresponding to the substantially central axis of the concave surface of the cavity so that the laser light enters into the phosphor layer from the concave surface of the cavity, wherein the concave surface of the cavity is configured to diffuse a laser light not entering into the phosphor layer from the concave surface.

In this case, in order for the phosphor layer to easily receive light diffused from the concave surface, the inner surface of the phosphor layer can be formed as a rough surface, in which an average roughness Ra of the rough surface of the phosphor layer is between 1.0 a and 50 a, and also the phosphor layer can further include a plurality of convex portions, which are located on the inner surface of the phosphor layer near the concave surface so as to project in a direction of the central axis of the concave surface and side by side in an extending direction of the clad layer, and each of the convex portions can include a planar surface extending in a direction perpendicular to the substantially central axis of the concave surface and an inclined surface inclining in a direction toward the opening of the cavity. In addition, the clad layer can extend toward the opening of the cavity within a range where it does not shade the laser light emitted from the semiconductor laser diode, in order to return light that may return toward the laser diode, again toward the concave surface of the cavity.

According to the above-described exemplary semiconductor light source apparatus, when the laser light gets to the concave surface, most of the laser light can enter into the phosphor layer while being refracted on the concave surface. In this case, a laser light not entering into the phosphor layer can be diffused on the concave surface, and most of the laser light can also enter into the phosphor layer that is formed in a relatively small shape due to diffusing lights. Thus, the disclosed subject matter can include providing semiconductor light source apparatuses having a high light-emitting efficiency, which can improve a light-emitting efficiency by promoting effective use of the back-reflection of the laser light.

According to another aspect of the disclosed subject matter, the semiconductor light source apparatus can include: a phosphor layer having a cavity formed in a dome shape, and including at least one phosphor material that converts at least one energy of blue light and ultraviolet light into light having a wavelength, an outer surface thereof including a light-emitting surface that includes at least one of a planar surface, a convex surface and a concave surface, a bottom surface thereof formed in a ring shape and being located between the outer surface and an inner surface thereof, the cavity including the inner surface of the phosphor layer, an opening surrounded by the bottom surface and a concave surface located opposite the opening, the concave surface of the cavity having a top end and a central axis formed in a rotational plane with respect to the central axis and connecting to the inner surface of the phosphor layer, and therefore the inner surface of the phosphor layer forming the concave surface of the cavity so as to project from the top end of the cavity; a clad layer formed in a ring shape, an inner surface thereof including a reflective material and being located adjacent the outer surface of the phosphor layer, a first opening thereof exposing the light-emitting surface from the outer surface of the phosphor layer, and a second opening thereof located adjacent the bottom surface of the phosphor layer; and a semiconductor laser diode emitting at least one laser light of the blue light and the ultraviolet light toward the concave surface of the cavity, an optical axis thereof corresponding to the substantially central axis of the concave surface of the cavity so that the laser light enters into the phosphor layer from the concave surface of the cavity, wherein the concave surface of the cavity of the phosphor layer is configured to diffuse a laser light not entering into the phosphor layer from the concave surface.

In this case, when the laser diode emits the ultraviolet light and when the phosphor layer includes a red phosphor, a green phosphor and a blue phosphor as the at least one phosphor material, the semiconductor light source apparatus can emit various color lights in accordance with each density of respective phosphors included in the phosphor layer. The structure including the concave surface of the cavity can also be used for exemplary embodiments set forth above. Likewise, any of the different features from the various disclosed embodiments can be interchanged or exchanged with each other in order to provide additional embodiments.

According to another aspect of the disclosed subject matter, the semiconductor light source apparatus can provide various light distributions using the above-described various color lights in accordance with an outer shape of the light-emitting surface exposed from the clad layer and a surface shape of the light-emitting surface, which can be formed using at least one of the planar surface, the convex surface and the concave surface. Thus, the disclosed subject matter can also provide semiconductor light source apparatuses having a high light-emitting efficiency, which can provide various light distribution patterns such as a wide range, a radial fashion and the like, and which can be used for various lighting units such as general lighting, a street light, a stage light, etc., as well as for vehicle lighting applications.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
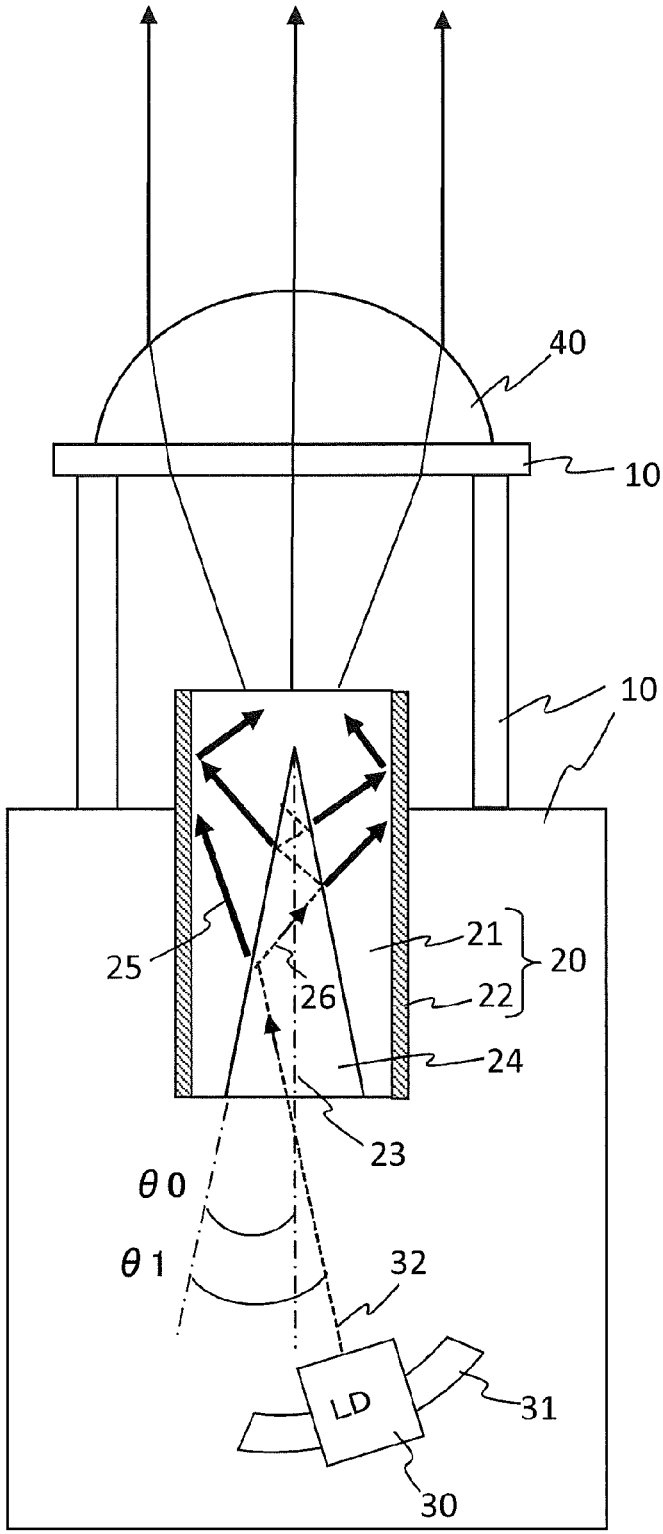
FIG. 1 is a schematic structural view showing a basic structure including moving directions of light rays for a first exemplary embodiment of a semiconductor light source apparatus made in accordance with principles of the disclosed subject matter.

The disclosed subject matter will now be described in detail with reference to FIGS. 1 to 15, in which the same, similar, or corresponding elements use the same reference marks. FIG. 1 is a schematic structural view showing a basic structure including moving directions of rays of a first exemplary embodiment of a semiconductor light source apparatus made in accordance with principles of the disclosed subject matter.

The semiconductor light source apparatus can include: a supporting board 10; an optical lens 40 having an optical axis 23 extending through and substantially perpendicular to the supporting board 10; a wavelength converting member 20 attached to the supporting board 10 so that the optical axis 23 of the optical lens 40 passes through the wavelength converting member 20; a semiconductor laser diode (hereinafter referred to as LD) 30 having an optical axis 32 along which a laser light is substantially uniformly and symmetrically emitted as an excitation light; and a movable rail 31 supporting the LD 30 so that one of the optical axis 32 of the LD 30 and an extended line of the optical axis 32 intersects with the optical axis 23 of the optical lens 40 at a prescribed inclined angle within a predetermined range.

The wavelength converting member 20 can be provided with a phosphor layer 21 having a top surface located toward the optical lens 40, a bottom surface located toward the LD 30, an inner surface receiving the laser light, an outer surface located between the top surface and the bottom surface, a cavity including the inner surface of the phosphor layer 21 as an outer surface thereof, a top edge located between the top surface and the outer surface and a bottom edge located between the bottom surface and the outer surface.

The wavelength converting member 20 can include a clad layer 22 having a first opening, a second opening and an inner surface formed in a ring shape, the inner surface being located adjacent the outer surface of the phosphor layer 21, the first opening thereof located adjacent the top edge of the phosphor layer 21, and the second opening thereof located adjacent the bottom edge of the phosphor layer 21.

Figure 2A:
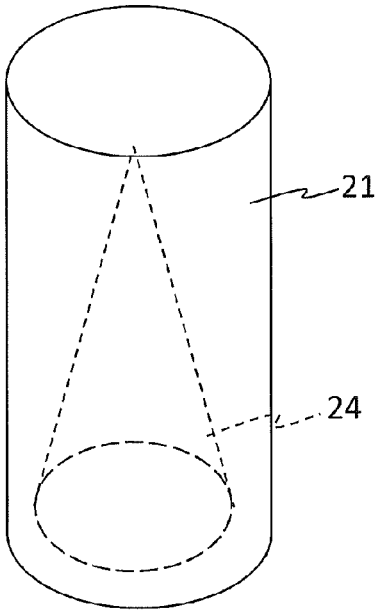
FIGS. 2*a* and 2*b* are a schematic perspective view and a cross-sectional view showing a phosphor layer used for the semiconductor light source apparatus shown in FIG. 1, respectively.
Figure 2B:
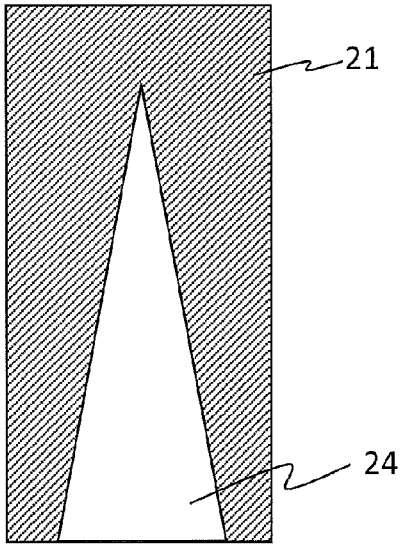

FIGS. 2*a* and 2*b* are a schematic perspective view and a cross-sectional view, respectively, showing the phosphor layer 21 used for the semiconductor light source apparatus shown in FIG. 1. The phosphor layer 21 of the wavelength converting member 20 can include at least one phosphor material for converting at least one energy of blue light and ultraviolet light that are included in the laser light into light having a wavelength, and can be formed in a basically columnar shape.

The wavelength converting member 20 can include a cavity 24 located adjacent the phosphor layer 21 and toward the LD 30, and the cavity 24 can include the inner surface of the phosphor layer 21, an opening surrounded by the bottom surface of the phosphor layer 21 and an end located opposite the opening. The cavity 24 can be configured to narrow from the opening toward the end of the cavity, for example, such as a conical shape having a central axis as shown in FIGS. 2*a* and 2*b*. In this case, the central axis of the conical shape can correspond to the optical axis 23 of the optical lens 40 in order to easily control light emitted from the top surface of the phosphor layer 21 toward the optical lens 40.

Therefore, most of the laser light 26 can enter into the phosphor layer 21 while it is refracted on an incident surface of the phosphor layer 21 in accordance with Snell's law, and laser light 26 that cannot enter into the phosphor layer 21 can be reflected by the inner surface of the phosphor layer 21, as shown by arrows 25 and 26, respectively, in FIG. 1. The reflective light 26 can move toward the end of the cavity 24, and most of the reflective light 26 can enter into the phosphor layer 21 while it is refracted on an incident surface of the phosphor layer 21, and laser light not entering into the phosphor layer 21 can be reflected by the inner surface of the phosphor layer 21.

Accordingly, the laser light can perfectly enter into the phosphor layer 21 without returning toward the LD 30 by repeating the above-described behavior, and can excite the phosphor material in the phosphor layer 21. In this case, the cavity 24 can be formed so that the inner surface of the phosphor layer 21 can move those portions of the laser light, which cannot enter into the phosphor layer 21, toward the end of the cavity 24 while repeatedly reflecting the laser light on the inner surface of the phosphor layer 21.

Because most of the laser light can enter into the phosphor layer 21 whenever the laser light gets to the inner surface of the phosphor layer 21, the greater the number of the reflection is, the larger an amount of the laser light that can enter into the phosphor layer 21 is and the smaller an amount of the laser light returning toward the LD 30 is.

In the first embodiment of the disclosed subject matter, the cavity 24 of the wavelength converting member 20 can be formed in a conical shape, in which the central axis of the circular cone corresponds to the optical axis 23 of the optical lens 40 as described above. An angle of the inner surface of the phosphor layer 21 can be θ0 with respect to the central axis of the cavity 24 as shown in FIG. 1. The angle θ0 of the inner surface of the phosphor layer 21 with respect to the central axis of the cavity 24 will be described in detail later.

The phosphor layer 21 can be made by dispersing a phosphor powder in a transparent material, and also a glass phosphor that adds a light-emitting ion into a glass and a phosphor ceramic that is composed of a single crystal phosphor or a poly crystal phosphor can be used as the phosphor layer 21, which can wavelength-convert the laser light emitted from the LD 30 into light having a prescribed wavelength. The transparent material in which the phosphor powder is dispersed can be an inorganic material such as a glass, a metallic oxide and the like, and also an organic material such as a silicone resin and the like.

When these materials are used as the transparent material, various manufacturing methods can be employed, such as one in which the phosphor powder is dispersed in an uncured transparent material and the uncured transparent material is injected in a mold for forming the cavity 24 when solidified. Another manufacturing method can form the cavity 24 using a grinding tool, a polishing pad and the like.

The phosphor ceramic can form the phosphor layer 21 by forming a phosphor in a molding tool forming the cavity 24 and by burning the phosphor. In this case, even when an organic material is used as a binder in a manufacturing process for the phosphor layer 21, because the organic component is burnt in a degreasing process after the forming process, the phosphor ceramic can include only the resin component of 5 wt percentages or less.

Therefore, because the above-described phosphor layer 21 does not include a substantial resin component and can be composed of only inorganic materials, tarnish is prevented in the phosphor layer 21 due to the heat generated from the laser light. In addition, the glass phosphor can have a high thermal conductivity in general, and therefore the radiating efficiency of the phosphor layer 21 that is composed of the glass phosphor can become high. Moreover, because the phosphor ceramic can generally have a higher thermal conductivity than that of the glass phosphor and a manufacturing cost for the poly crystal phosphor ceramic may be lower than that for the single crystal phosphor ceramic, the poly crystal phosphor ceramic can be used as the phosphor layer 21.

A matter located in the cavity 24 can be a matter having a lower refraction than that of the phosphor layer 21 in order to prevent the laser light from total reflection on the inner surface of the phosphor layer 21. Accordingly, at least one of air and inert gas can be filled in the cavity 24, and also a vacuum state can be maintained in cavity 24. In addition, a transparent material having a lower refraction than that of the phosphor layer 21 such as a liquid and a solid can also be filled in the cavity 24.

The clad layer 22 can reflect a wavelength converted light emitted in the phosphor layer 21 that is excited by a part of the laser excitation light and can also reflect another part of the laser light that is not excited by the phosphor layer 21, by using the inner surface thereof. Accordingly, the clad layer can move a mixture light including the wavelength converted light and the other part of the laser light toward the top surface of the phosphor layer 21.

The clad layer 22 can be formed of a metallic layer, and the metallic layer can be made of a metal having a high reflectivity such as a silver, aluminum and the like, which is formed by a vapor deposition method. The clad layer 22 can also be formed of a white reflective layer such as titanic oxide, zinc oxide and the like dispersed in a binder which can be formed in a thin film by a coating method.

The optical lens 40 can be formed as a projector lens and the like, which can be used to provide a favorable light distribution pattern and which can be used with a wavelength converted light emitted from the top surface of the phosphor layer 21. If the wavelength converted light emitted from the top surface of the phosphor layer 21 has a favorable light distribution pattern such that it is a match for a particular usage, the semiconductor light source apparatus does not necessarily need to be provided with the optical lens 40.

In this case, the top surface of the phosphor layer 21 can include at least one of a planar surface, a convex surface and a concave surface, and therefore can be formed as a light-emitting surface of the semiconductor light source apparatus using the at least one of the planar surface, the convex surface and the concave surface so as to provide the favorable light distribution pattern.

Next, operations of the first embodiment of the semiconductor light source apparatus shown in FIG. 1 will now be described. The LD 30 can be fine-tuned by the movable rail 31 so that an incident angle of the laser light emitted from the LD 30 becomes θ1 with respect to the inner surface of the phosphor layer 21. The incident angle θ1 can be determined so that the laser light can move toward the end of the cavity 24 while it repeats a plurality of reflections on the inner surface of the phosphor layer 21.

In this case, an incident angle should be defined as an angle with respect to a normal line at an incident surface in general. However, in the first embodiment of the disclosed subject matter, the incident angle θ1 of the laser light is defined as an angle with respect to the inner surface of the phosphor layer 21, which becomes an incident surface of the laser light, in order to facilitate an understanding of the disclosed subject matter.

When the laser light emitted from the LD 30 gets to the inner surface of the phosphor layer 21 at the incident angle θ1, most of the laser light can enter into the phosphor layer 21 while it is refracted on the inner surface of the phosphor layer 21 in accordance with Snell's law as shown by arrows 25 in FIG. 1. At this time a laser light that cannot enter into the phosphor layer 21 can be reflected on the inner surface of the phosphor layer 21 as shown by arrows 26 in FIG. 1.

Figure 3:
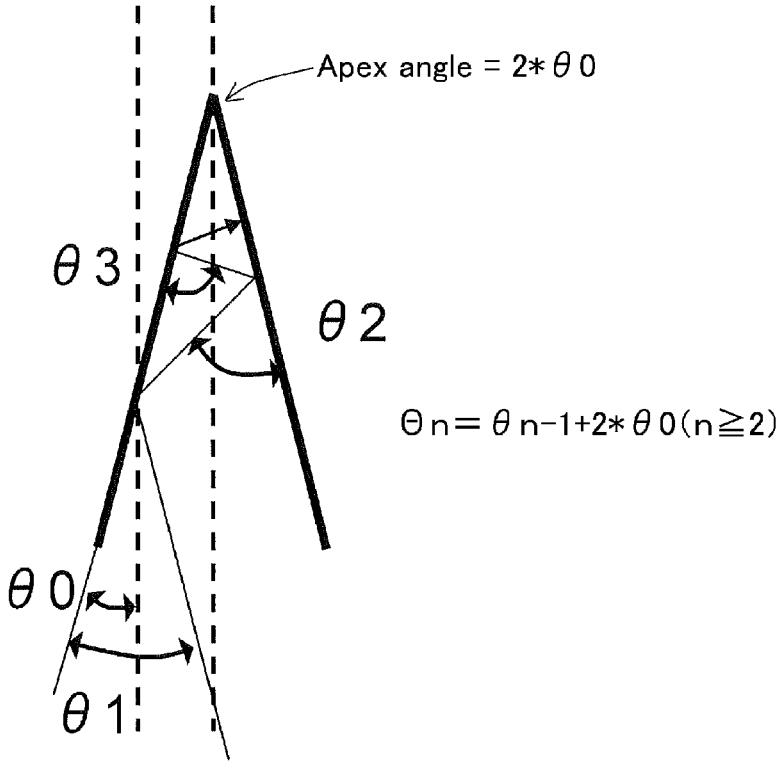
FIG. 3 is an explanatory drawing depicting incidents angles of a laser light with respect to an inner surface of the phosphor layer shown in FIG. 2*b;*

FIG. 3 is an explanatory drawing depicting incidents angles of the laser light with respect to the inner surface of the phosphor layer 21 shown in FIG. 2*b*. The reflective light 26 can move toward the end of the cavity 24, and most of the reflective light 26 can enter into the phosphor layer 21 at a second incident angle θ2 while it is refracted on the inner surface of the phosphor layer 21, and also a reflective light 26 that cannot enter into the phosphor layer 21 at this time can be reflected by the inner surface of the phosphor layer 21 and can move further toward the end of the cavity 24. Additionally, most of the reflective light can enter into the phosphor layer 21 at a third incident angle θ3.

When an n-th incident angle of the laser light with respect to the inner surface of the phosphor layer 21 is referred to as θn, the above-described reflection may repeat until θn becomes 90 degrees. When θn becomes more than 90 degrees, the reflective light may become a returning light, which returns toward the LD 30. That is to say, $\theta 2=\theta 1+2*\theta 0$, $\theta 3=\theta 2+2*\theta 0$, and $\theta n=\theta n-1+2*\theta 0$ (an apex angle of the end of the cavity) may be defined as the n-th incident angle θn.

Here, if one imagines that when the laser light gets to the inner surface of the phosphor layer 21, 90 percent of the laser light may enter into the phosphor layer 21 and 10 percent of the laser light may be reflected on the inner surface, 90 percent of the laser light at the first accession, 9 percent of the laser light at the second accession and 0.9 percent of the laser light at the third accession may enter into the phosphor layer. Then, 99.99 percent of the laser light may enter into the phosphor layer 21 at the fourth accession of the laser light.

Therefore, because an amount of the laser light entering into the phosphor layer 21 can increase by increasing the number of the reflections of the laser light on the inner surface of the phosphor layer 21, thereby the semiconductor light source apparatus can also enhance a light-emitting efficiency. In this case, the n-th incident angle θn may become $\theta n-1+2*\theta 0$, and the n-th incident θn of less than 90 degrees is required to eliminate the returning light toward the LD 30.

Accordingly, the angle θ0 of the inner surface of the phosphor layer 21 with respect to the central axis of the cavity 24 and the incident angle θ1 of the laser light can be reduced within a range where the inner surface of the cavity 21 can receive the laser light emitted from the LD 30. A distance between the end and the opening of the cavity 21 can be determined in accordance with the desirable number of the reflection on the inner surface of the phosphor layer 21 of the laser light, the angle θ0 of the inner surface of the phosphor layer 21 and the incident angle θ1 of the laser light.

Figure 4:
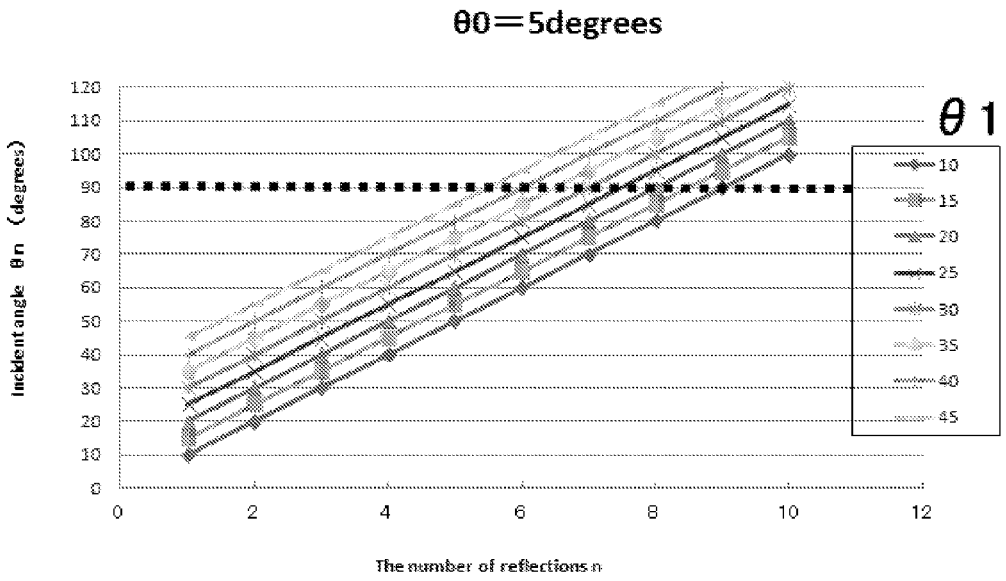
FIG. 4 is a graph showing a relationship between the number of reflections n and an incident angle θn of the laser light when an angle θ0 of an inner surface of the phosphor layer with respect to a central axis of a cavity is 5 degrees in the embodiment of FIG. 1.
Figure 5:
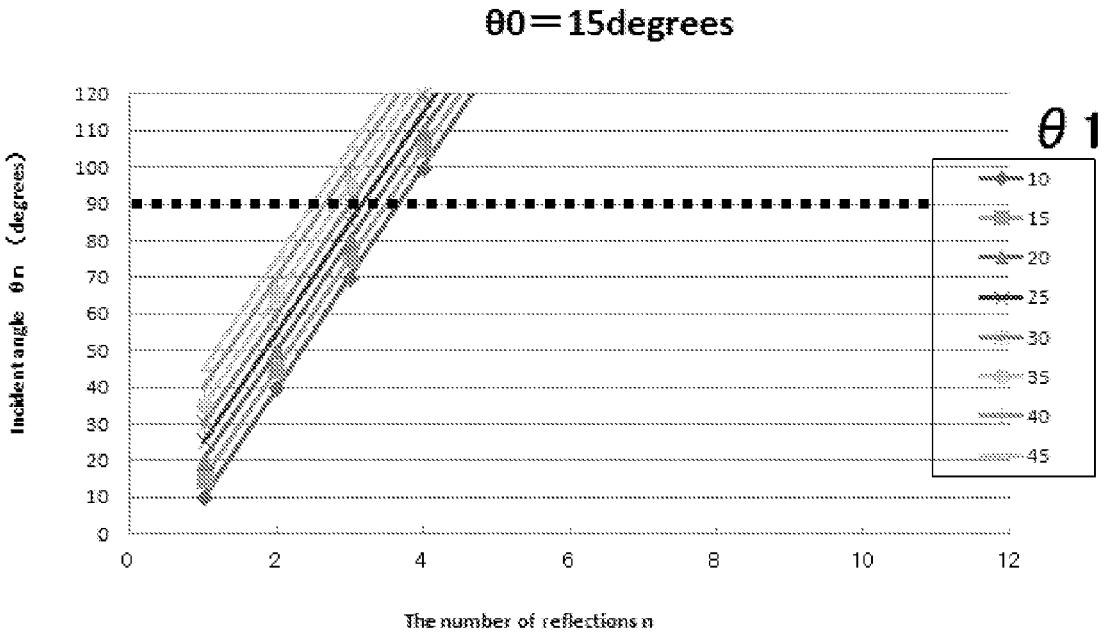
FIG. 5 is a graph showing a relationship between the number of reflections n and an incident angle θn of the laser light when an angle θ0 of an inner surface of the phosphor layer with respect to a central axis of a cavity is 15 degrees in the embodiment of FIG. 1.

FIGS. 4 and 5 are graphs showing a relationship between the number of reflections n and an incident angle θn of the laser light when an angle θ0 of an inner surface of the phosphor layer with respect to a central axis of a cavity is 5 degrees and 15 degrees in the first embodiment, wherein the incident angle θ1 of the laser excitation light varies every 5 degrees between 10 and 45 degrees, respectively.

As shown in FIGS. 4 and 5, in order to increase the number of reflections on the inner surface of the phosphor layer and to enhance a light-emitting efficiency of the light source apparatus, the angle θ0 of the inner surface of the phosphor layer 21 with respect to the central axis of the cavity 24 and the incident angle θ1 of the laser light can be reduced within a range where the inner surface of the cavity 21 can receive the laser light emitted from the LD 30.

A part of the laser light entering into the phosphor layer 21 can be wavelength-converted by the phosphor material included in the phosphor layer 21, and another part of the laser light may pass through the phosphor layer 21 without wavelength conversion. In order to be provided with the clad layer 22 around the phosphor layer 21, the clad layer 22 can reflect a wavelength converted light excited by the phosphor material in the phosphor layer 21 along with the other part of the laser light that is not excited by the phosphor material of the phosphor layer 21, and may move this light towards the top surface of the phosphor layer 21.

Accordingly, the mixture light of the wavelength converted light and the other part of the laser light can be emitted directly or via the clad layer 22 from the top surface of the phosphor layer 21 toward the optical lens 40. The semiconductor light source apparatus can provide various light distribution patterns using the mixture light and an optical characteristic of the optical lens 40, for example, such as a light distribution pattern for a high beam headlight, a light distribution for a projector, etc.

As the LD 30, a blue laser diode of GaN series that emits blue light having a light-emitting wavelength of 400 to 500 nanometers can be used. In this case, when the phosphor layer 21 includes a yellow phosphor wavelength-converting the blue light into yellow light and when the LD 30 emits the blue light, the semiconductor light source apparatus can emit substantially white light due to an additive color mixture using light excited by the yellow phosphor and a part of the blue light that is not excited by the yellow phosphor.

In addition, when the phosphor layer 21 includes a red phosphor wavelength-converting blue light into purple light and a green phosphor wavelength-converting the blue light into blue-green light and when the LD 30 emits the blue light, the semiconductor light source apparatus can also emit substantially white light due to an additive color mixture using light excited by the two phosphors and a part of the blue light that is not excited by the phosphors.

In these cases, $CaAlSiN_3$: $Eu^{2+}$, $Ca_2Si_5N_8$: $Eu^{2+}$, $La_2O_2S$: $Eu^{3+}$, $KSiF_6$: $Mn^{4+}$, $KTiF_6$: $Mn^{4+}$ and the like can be used as the red phosphor of the phosphor layer 21. $Y_3(Ga, Al)_5O_{12}$: $Ce^{3+}$, $Ca_3Sc_2Si_3O_{12}$: $Ce^{3+}$, $CaSc_2O_4$: $Eu^{2+}$, $(Ba, Sr)_2SiO_4$: $Eu^{2+}$, $Ba_3Si_6O_{12}N_2$: $Eu^{2+}$, $(Si, Al)_6$ (O, N): $Eu^{2+}$ and the like can be used as the green phosphor. As the yellow phosphor, $Y_3Al_5O_{12}$: $Ce^{3+}$ (YAG), $(Sr, Ba)_2 SiO_4$: $Eu^{2+}$, $Ca_x (Si, Al)_{12} (O, N)_{16}$: $Eu^{2+}$ and the like can be used.

A laser diode that emits ultraviolet light can also be used as the LD 30. In this case, the phosphor layer 21 can include at least one phosphor that wave-converts the light emitted from the LD 30 into light having a prescribed wavelength. For example, when the phosphor layer 21 includes a red phosphor wavelength-converting ultraviolet light into red light, a green phosphor wavelength-converting the ultraviolet light into green light and a blue phosphor wavelength-converting the ultraviolet light into blue light and when the LD 30 emits the ultraviolet light, the semiconductor light source apparatus can emit substantially white light due to an additive color mixture using light excited by the three phosphors.

In this case, $CaAlSiN_3$: $Eu^{2+}$, $Ca_2Si_5N_8$: $Eu^{2+}$, $La_2O_2S$: $Eu^{3+}$, $KSiF_6$: $Mn^{4+}$, $KTiF_6$: $Mn^{4+}$ and the like can be used as the red phosphor of the phosphor layer 21. $(Si, Al)_6 (O, N)$: $Eu^{2+}$, $BaMgAl_{10}O_{17}$: $Eu^{2+}$ $Mn^{2+}$, $(Ba, Sr)_2SiO_4$: $Eu^{2+}$ and the like can be used as the green phosphor. $(Sr, Ca, Ba, Mg)_{10} (PO_4)_6C_{12}$: $Eu^{2+}$, $BaMgAl_{10}O_{17}$: $Eu^{2+}$, $LaAl (Si, Al)_6 (N, O)_{10}$: $Ce^{3+}$ can be used as the blue phosphor. In addition, the semiconductor light source apparatus can emit various color lights due to an additive color mixture using light excited by varying each of the densities of the red phosphor, the green phosphor and the blue phosphor included in the phosphor layer 21.

The clad layer 22 can perform an operation to reflect the light emitted from the outer surface of the phosphor layer 21 and to move the light toward the top surface of the phosphor layer 21. However, when the semiconductor light source apparatus emits a wavelength converted light over a wide range of a radial fashion, the semiconductor light source apparatus does not necessarily need to be provided with the clad layer 22. The clad layer 22 can also be partially located around the outer surface of the phosphor layer 21 and, for example, can be located only around a part of the outer surface of the phosphor layer 21 toward the optical lens 40 such that the reflections of the laser light may frequently occur.

In addition, the first embodiment can include the movable rail 31 so as to be able to fine-tune the incident angle θ1 of the laser light. However, the LD 30 can also be attached to the supporting board 10 directly without the movable rail 31 while maintaining the incident angle θ1 of the laser light fine-tuned. Moreover, the inner surface of the phosphor layer 21 can be formed in a mirror surface in order to prevent diffusion of the laser light and, for example, can be formed as a surface having an average surface roughness of less than Ra 1.0 a.

As described above, a back-reflection of the laser light can be prevented by repeating the reflections of the laser light on the inner surface of the phosphor layer 21 toward the top surface of the phosphor layer 21. Thus, the first embodiment of the disclosed subject matter can provide semiconductor light source apparatuses which can emit various color lights including white color tone having a high light-emitting efficiency such that the device can be used as a light source for a vehicle headlight, a projector and the like, and which can improve a light-emitting efficiency by preventing the above-described back-reflection.

Figure 6:
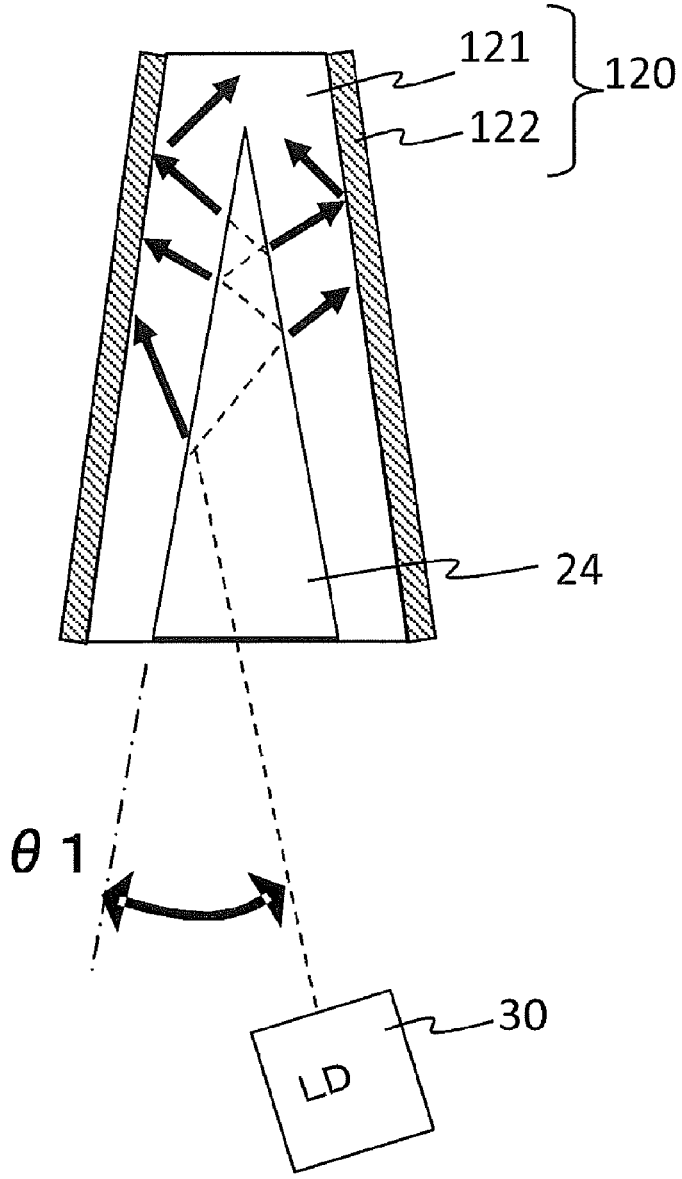
FIG. 6 is a cross-sectional structural view showing a wavelength converting member and moving directions of light rays for a second exemplary embodiment of a semiconductor light source apparatus made in accordance with principles of the disclosed subject matter.

FIG. 6 is a cross-sectional structural view showing a wavelength converting member and moving directions of light rays of a second exemplary embodiment of a semiconductor light source apparatus. A difference between the second embodiment and the first embodiment of the semiconductor light source apparatus relates to the wavelength converting member 120, which in the embodiment of FIG. 6 is formed in a circular truncated cone shape such that a diameter of the wavelength converting member 120 gradually thins from an opening of a phosphor layer 121 toward a top surface of the phosphor layer 121.

Accordingly, the phosphor layer 121 surrounded by a clad layer 122 of the wavelength converting member 120 can be formed in a circular truncated cone shape, so that the top surface of the phosphor layer 121 for emitting a wavelength converted light thins as compared with the first embodiment. Other structures of the second embodiment can be the same as the first embodiment. Therefore, the semiconductor light source apparatus of the second embodiment can provide a wavelength converted light having a higher density and a higher intensity than those of the first embodiment.

Figure 7A:
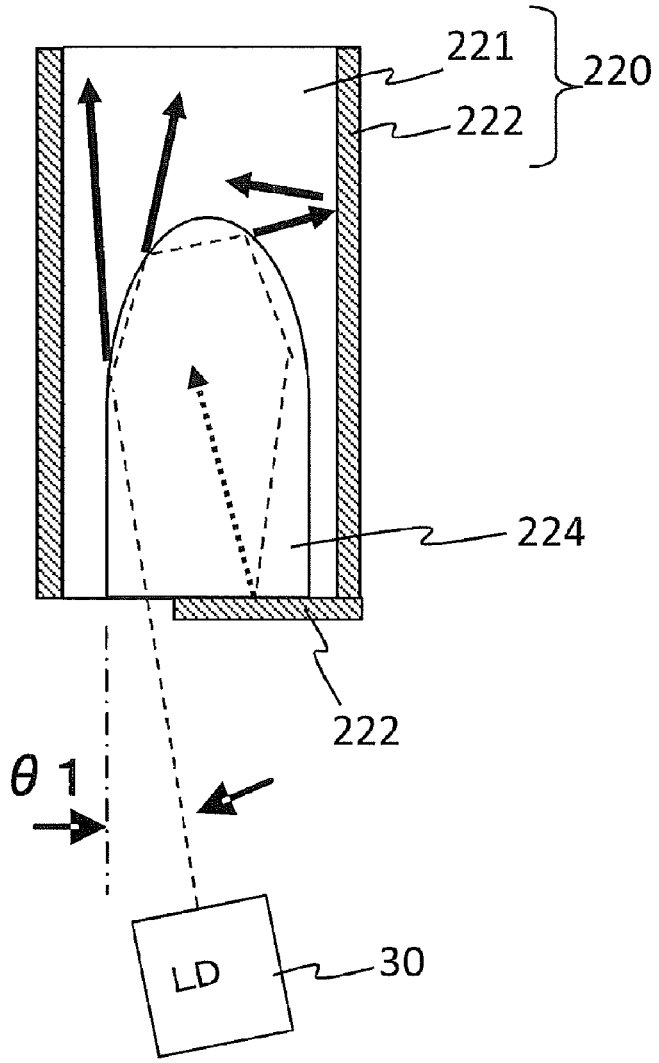
FIG. 7*a* is a cross-sectional structural view showing a wavelength converting member and moving directions of light rays for a third exemplary embodiment of a semiconductor light source apparatus made in accordance with principles of the disclosed subject matter.
Figure 7B:
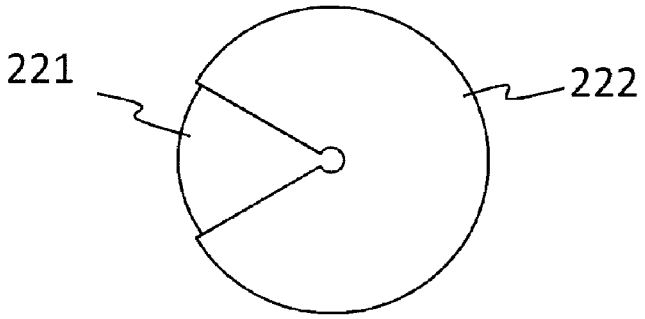
FIG. 7*b* is a rear view showing the wavelength converting member of FIG. 7*a;*

FIG. 7*a* is a cross-sectional structural view showing a wavelength converting member and moving directions of light rays of a third exemplary embodiment of a semiconductor light source apparatus, and FIG. 7*b* is a rear view showing the wavelength converting member of FIG. 7*a*. Differences between the third embodiment and the first embodiment of the semiconductor light source apparatus relate to the wavelength converting member 220 and an incident angle θ1 of the laser light emitted from the LD 30.

A cavity 224 of the third embodiment can form an inner surface of the phosphor layer 221 that is surrounded by a clad layer 222 of the wavelength converting member 220, and can be formed in a bullet shape, which is different from the conical shape of the cavity 24 in the first embodiment. In addition, the clad layer 222 surrounding the phosphor layer 221 can extend toward or over an opening of the cavity 224 so as to cover most parts of a bottom surface of the phosphor layer 221 and the opening of the cavity 224 as shown in FIG. 7*a*.

A part of the clad layer 222 covering the bottom surface of the phosphor layer 221 and the opening of the cavity 224 can be formed in, for example, a fan-like shape as shown in FIG. 7*b*. Accordingly, a shape of the bottom surface of the phosphor layer 221 and the opening of cavity 224 that are exposed from the part of the clad layer 222 can also become a fan-like shape. However, the shape is not limited to the fan-like shape, and can be formed in various shapes such as a circular shape and the like, if the opening of the cavity 224 exposed from the clad layer 222 becomes enterable to the laser light having an incident angle θ1 with respect to the inner surface of the phosphor layer 221.

In this case, the laser light entering into the cavity 224 may repeat reflections on the inner surface of the phosphor layer 221 many times, wherein each and every time most of the laser light can enter into the phosphor layer 221. When the incident angle θn of the laser light becomes more than 90 degrees, the reflective light may return toward the opening of the cavity 224. However, because most of the opening of the cavity 224 is covered with the clad layer 222, the reflective light may repeat reflections on the inner surface of the phosphor layer 221 again after it is reflected on the inner surface of the clad layer 222.

Consequently, even when the incident angle θn of the laser light becomes more than 90 degrees, because the reflective light can be returned in a direction of the inner surface of the phosphor layer 221, the number of the reflections can increase. Thus, the semiconductor light source apparatus of the third embodiment can also improve a light-emitting efficiency because an amount of the laser light entering into the phosphor layer 221 can increase.

Figure 8:
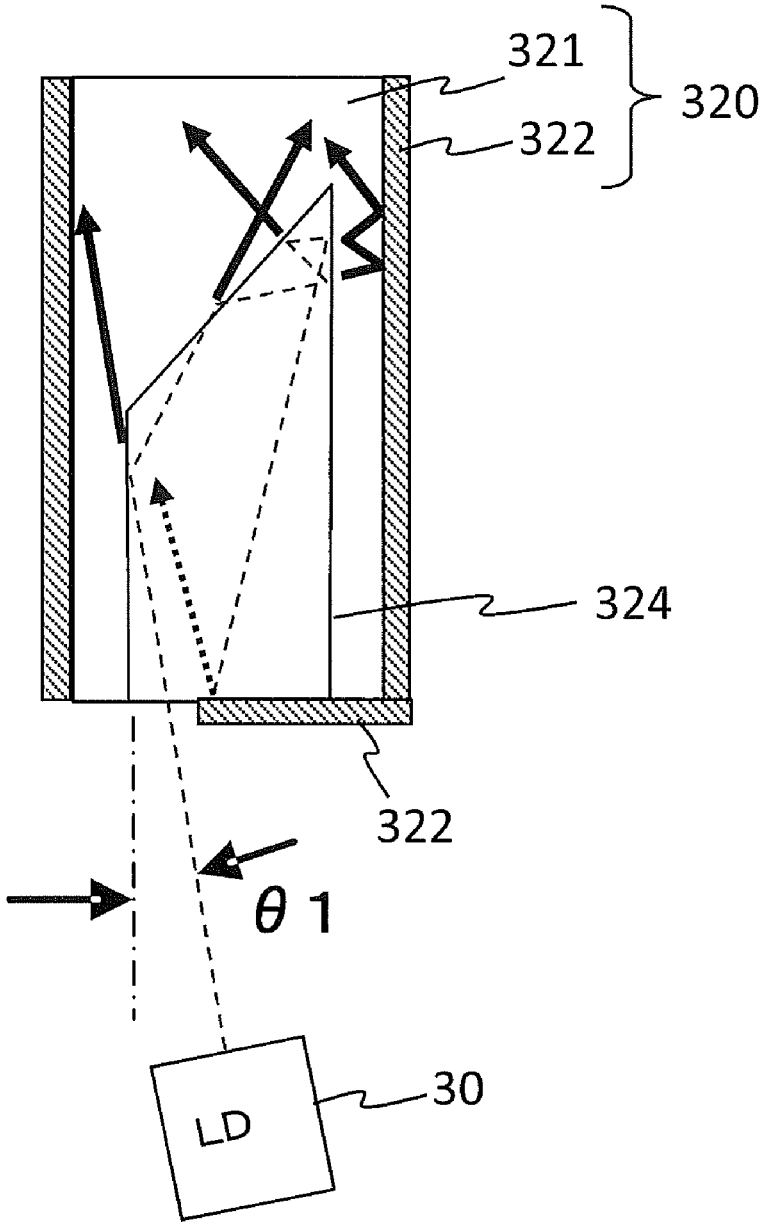
FIG. 8 is a cross-sectional structural view showing a wavelength converting member and moving directions of light rays for a fourth exemplary embodiment of a semiconductor light source apparatus made in accordance with principles of the disclosed subject matter.

FIG. 8 is a cross-sectional structural view showing a wavelength converting member and moving directions of light rays of a fourth exemplary embodiment of a semiconductor light source apparatus. A difference between the fourth embodiment and the third embodiment of the semiconductor light source apparatus relates to a phosphor layer 321 of the wavelength converting member 320, in which a clad layer 322 is basically the same as the clad layer 222 of the third embodiment.

A cavity 324 that can form an inner surface of the phosphor layer 321 can be formed in a tapered cylinder shape, such that a diagonal cut is formed in a cylinder from a top edge toward a halfway point located on opposite side of the top edge. The clad layer 322 can cover an outer surface of the phosphor layer 321 and most parts of a bottom surface of the phosphor layer 321 and an opening of the cavity 324 in common with the clad layer 222 of the third embodiment.

Therefore, in the wavelength converting member 320 of the fourth embodiment, the laser light having an incident angle θ1 can enter into the cavity 324 from a part of the opening of the cavity 324 that is not covered with the clad layer 322, and most of the laser light can enter into the phosphor layer 321. A laser light that cannot enter into the phosphor layer 321 may repeat reflections on the inner surface of the phosphor layer 321 many times. Whenever the laser light is reflected on the inner surface of the phosphor layer 321, most of the laser light can enter into the phosphor layer 321.

When the incident angle θn of the laser light becomes more than 90 degrees, the reflective light may return toward the opening of the cavity 324. However, the reflective light may get to the inner surface of the phosphor layer 321 again after it is reflected on an inner surface of the clad layer 322. Then, a reflective light not entering into the phosphor layer 321 can very often repeat reflections on the inner surface of the phosphor layer 321, and most of the reflective light may enter into the phosphor layer 321. Accordingly, the semiconductor light source apparatus of the fourth embodiment can also improve a light-emitting efficiency because an amount of the laser light entering into the phosphor layer 321 can increase.

Figure 9:
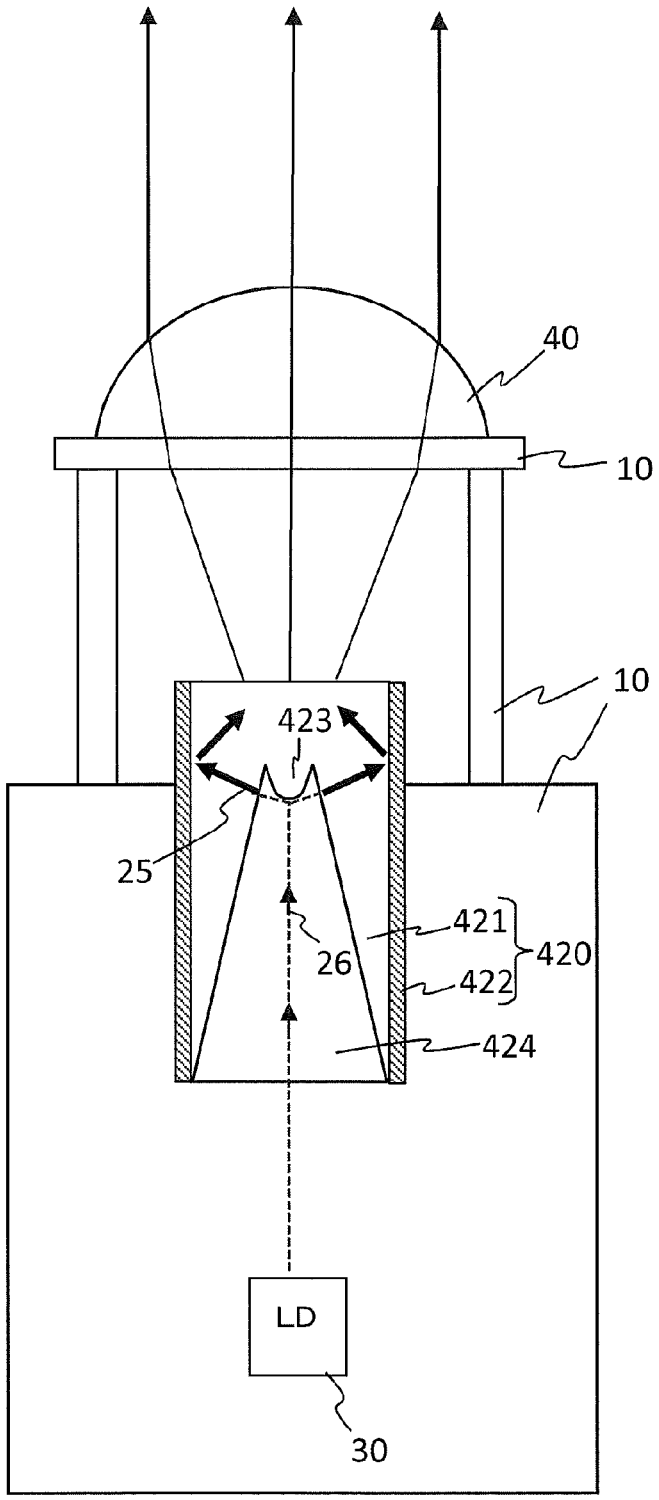
FIG. 9 is a schematic structural view showing a basic structure including moving directions of light rays of a fifth exemplary embodiment of a semiconductor light source apparatus made in accordance with principles of the disclosed subject matter.

A fifth exemplary embodiment of the semiconductor light source apparatus will now be described with reference to FIGS. 9 and 10. FIG. 9 is a schematic structural view showing a basic structure including moving directions of light rays of the fifth exemplary embodiment of a semiconductor light source apparatus. Differences between the fifth embodiment and the first embodiment of the semiconductor light source apparatus relate to a cavity 424 of the wavelength converting member 420 and an incident angle of the laser light emitted from the LD 30.

The wavelength converting member 420 can include a phosphor layer 421, a clad layer 422 formed in a cylindrical shape and surrounding an outer surface of the phosphor layer 421, and the cavity 424 having an opening formed in a substantially conical shape and being located adjacent the phosphor layer 421 so that the opening thereof faces the LD 30 in common with the first embodiment.

However, the cavity 424 can include a convex surface 423 at the end portion thereof, which is different from the aculeate end of the cavity 24 in the first embodiment. The LD 30 can be arranged so that the laser light having a beam radius R can enter into the cavity 424 along the central axis of the wavelength converting member 420 substantially corresponding to the optical axis of the optical lens 40.

Figure 10:
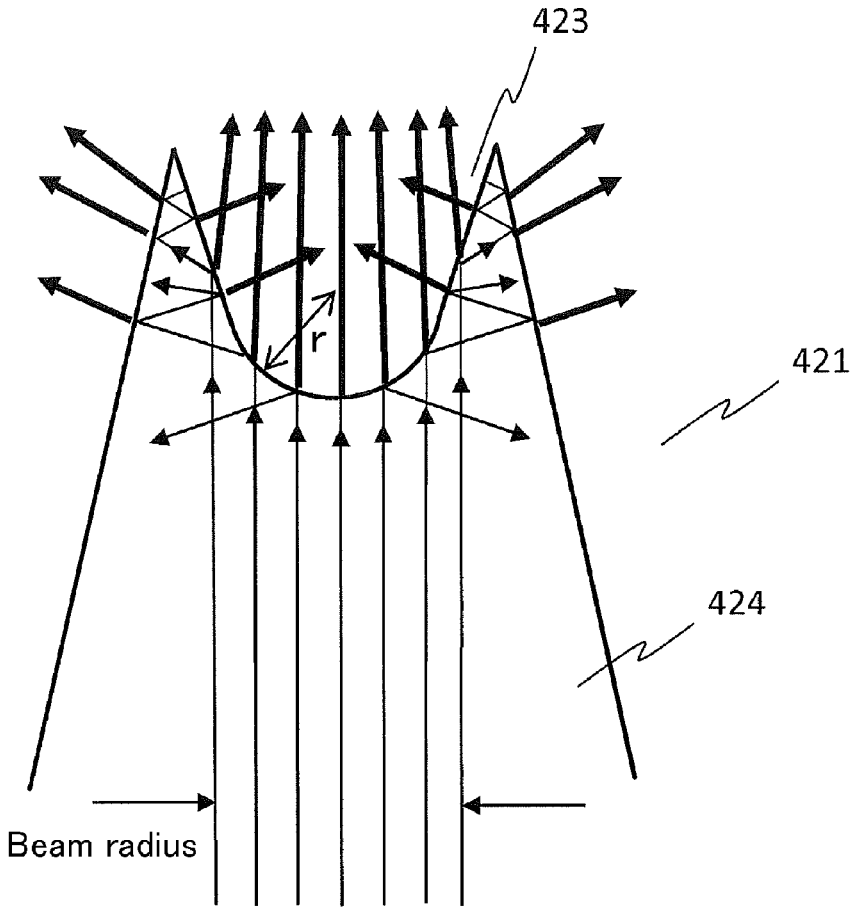
FIG. 10 is a cross-sectional explanatory drawing depicting a structure of an end portion of a cavity and moving directions of light rays in the embodiment of the semiconductor light source apparatus shown in FIG. 9.

FIG. 10 is a cross-sectional explanatory drawing depicting a structure of the end portion of the cavity 424 and also depicting moving directions of light rays in the fifth embodiment of FIG. 9. A bottom portion of the convex surface 423 can be formed in a spherical shape having a radius r. When the laser light having the beam radius R emitted from the LD 30 gets to the convex surface 423, most of the laser light can enter into the phosphor layer 421 while being refracted on the convex surface 423. At this time a laser light that cannot enter into the phosphor layer 421 may be reflected on the convex surface 423 at reflective angles based upon incident angles thereof.

The convex surface 423 can be formed in a rotational plane, and therefore can diffuse the laser light not entering into the phosphor layer 421 around the convex surface 423 and can get to the inner surface of the phosphor layer 421. Accordingly, while a reflective light that cannot enter into the phosphor layer 421 may repeat reflections between the convex surface 423 and the inner surface of the phosphor layer 421, most of the reflective light can enter into the phosphor layer 421 whenever being reflected on the inner surface of the phosphor layer 421.

Therefore, the semiconductor light source apparatus of the fifth embodiment can also improve a light-emitting efficiency because an amount of the laser light entering into the phosphor layer 421 can increase in common with the above-described embodiments. In the fifth embodiment, because the reflections may likely occur near the end portion of the cavity 424 including the convex surface 423, a length of the wavelength converting member 420 may be reduced as compared with the above-described embodiments.

The radius r of the bottom portion of the convex surface 423 can be shrunk to be smaller than the beam radius R of the laser light. When the radius r of the bottom portion of the convex surface 423 is larger than the beam radius R of the laser light, because the laser light getting to the convex surface 423 may be less subject to diffusion than a case where the radius r is smaller than the beam radius R of the laser light, a returning light toward the LD 30 in the laser light getting to the convex surface 423 may increase.

In addition, a diameter of a top end of the convex surface 423 can greater than the beam radius R of the laser light. When the beam radius R of the laser light is larger than the diameter of the top end of the convex surface 423, because the laser light may get to a part of the inner surface of the phosphor layer 421 other than the convex surface 423, the laser light may be less subject to a diffusion than a case where the beam radius R of the laser light is smaller than the diameter of the top end of the convex surface 423. Accordingly, the fifth embodiment can be structured so as to enlarge, in order, the diameter of the top end of the convex surface 423, the beam radius R of the laser light, and the radius r of the bottom portion of the convex surface 423.

Moreover, the bottom portion of the convex surface 423 can also be formed in a conical shape, a polygonal cone shape such as a pyramid structure and the like, in addition to the spherical shape having a radius r.

Furthermore, the phosphor layer 421 surrounded by the clad layer 422 of the wavelength converting member 420 can also be formed in a circular truncated cone in common with the phosphor layer 121 in the second embodiment. In this case, because the phosphor layer 421 can thin toward the top surface thereof for emitting a wavelength converted light due to the circular truncated cone, the wavelength converted light can be emitted from a small top surface of the phosphor layer 421 while condensing the light on the small top surface. Thus, the structure can provide a semiconductor light source apparatus that can emit a wavelength converted light having a higher density and a higher intensity.

Figure 11:
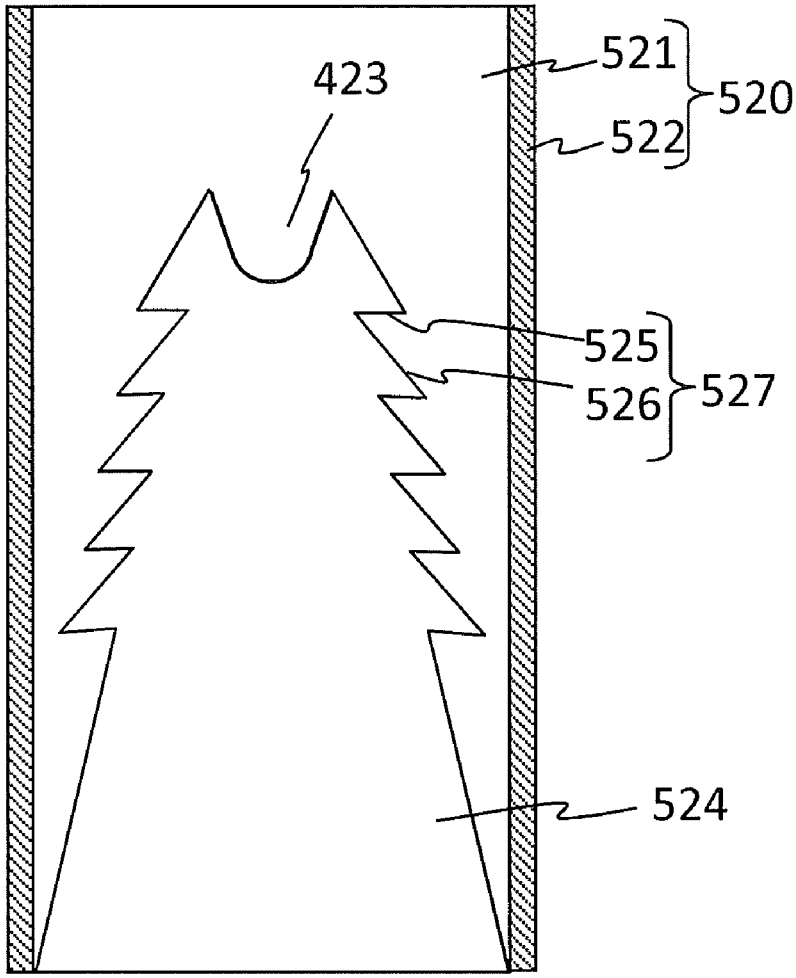
FIG. 11 is a schematic structural view showing a wavelength converting member in a sixth exemplary embodiment of a semiconductor light source apparatus made in accordance with principles of the disclosed subject matter.

A sixth exemplary embodiment of the semiconductor light source apparatus will now be described with reference to FIGS. 11 to 13. FIG. 11 is a schematic structural view showing a wavelength converting member in a sixth exemplary embodiment of the semiconductor light source apparatus. A difference between the sixth embodiment and the fifth embodiment of the semiconductor light source apparatus relate to a cavity 524 of the wavelength converting member 520.

The wavelength converting member 520 can include a phosphor layer 521, a clad layer 522 formed in a cylindrical shape and surrounding an outer surface of the phosphor layer 521, the cavity 524 having an opening formed in a basically conical shape, being located adjacent the phosphor layer 521 so that the opening thereof faces the LD 30 and including the convex surface 423 at the end portion thereof in common with the fifth embodiment.

In addition, the phosphor layer 521 can include a plurality of convex portions 527, located so as to project in an inward direction of the clad layer 522 and side by side in an extending direction of the clad layer 522 on an inner surface of the phosphor layer 521 near the concave surface 423. Each of cross-sectional shapes of the convex portions 527 taken along a central axis of the cavity 524 formed in the conical shape can be jagged, and each of the convex portions 527 can include a planar surface 525 extending in a direction perpendicular to the central axis of the cavity 524 and an inclined surface 526 inclining in a direction toward the opening of the cavity 524.

Figure 12:
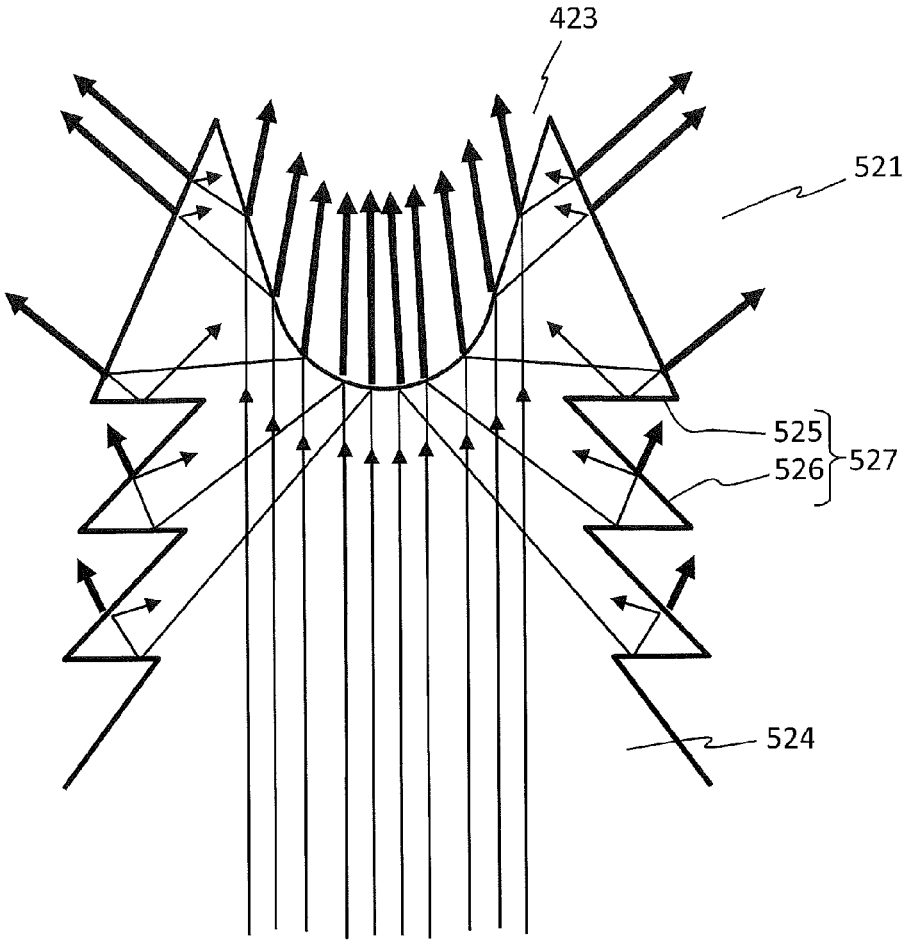
FIG. 12 is a cross-sectional explanatory drawing depicting a structure of an end portion of a cavity and moving directions of light rays in the wavelength converting member of the embodiment shown in FIG. 11.

FIG. 12 is a cross-sectional explanatory drawing depicting a structure of the end portion of the cavity 524 and depicting moving directions of light rays in the wavelength converting member 520 of the sixth embodiment shown in FIG. 11. By locating the convex portions 527 formed in a jagged shape in the direction perpendicular to the central axis of the cavity 524, most of the retuning light caused by reflecting the laser light toward the LD 30 on the convex surface 423 can enter into the phosphor layer 521 after the returning light moves toward at least one of the end portion of cavity 524 and the inner surface of the phosphor layer 521 using at least one of the planar surface 525 and the inclined surface 526 of each of the convex portions 527.

Accordingly, the semiconductor light source apparatus of the sixth embodiment can also improve a light-emitting efficiency because an amount of the laser light entering into the phosphor layer 521 can increase and an amount of the returning light toward the LD 30 can be reduced. In this case, the phosphor layer 521 can be made by making a plurality of phosphor layers divided by each of surfaces taken along the planar surfaces 525 of the concave portions 527 using the above-described manufacturing method and by overlapping the plurality of phosphor layers. Additionally, the phosphor layer 521 can also be made by making two same phosphor layers that are divided by a vertical surface including the central axis of cavity 524 and by sticking or adhering the two phosphor layers together.

Figure 13:
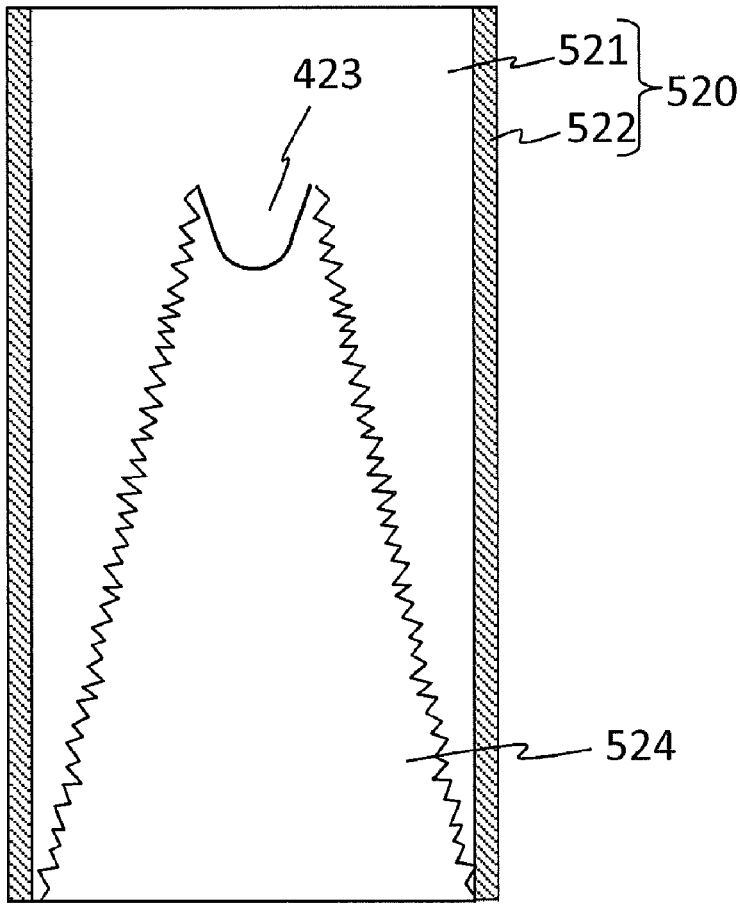
FIG. 13 is a cross-sectional explanatory drawing depicting an exemplary variation of the wavelength converting member of the embodiment shown in FIG. 11.

FIG. 13 is a cross-sectional explanatory drawing depicting an exemplary variation of the wavelength converting member 520 in the sixth embodiment. The inner surface of the phosphor layer 521 can be formed as a rough surface, which includes alternately a concave and a convex in place of the convex portions 527. In this case, an average roughness Ra of the rough surface of the phosphor layer 521 can be between 1.0 a and 50 a. Thereby, most of the returning light caused by reflection of the laser light toward the LD 30 on the convex surface 423 can move toward the end portion of cavity 524 by diffusing the returning light on the rough surface including the alternate concave and the convex surfaces.

Therefore, the semiconductor light source apparatus, which includes the rough surface on the inner surface of the phosphor layer 521, can also improve a light-emitting efficiency because an amount of the returning light toward the LD 30 can be reduced and an amount of the laser light entering into the phosphor layer 521 can be increased.

Figure 14:
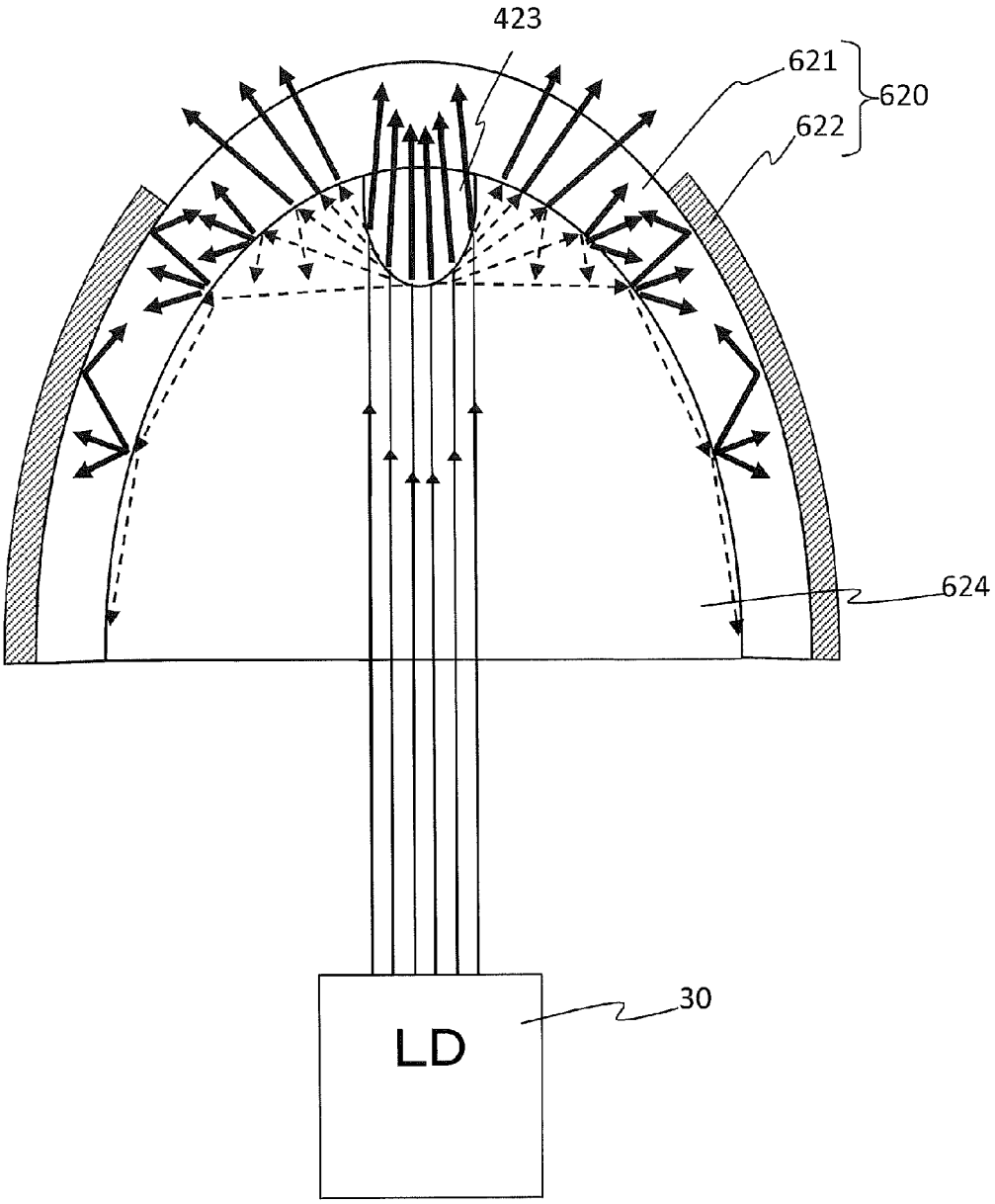
FIG. 14 is a schematic structural view showing a basic structure including moving directions of light rays for a seventh exemplary embodiment of a semiconductor light source apparatus made in accordance with principles of the disclosed subject matter.

A seventh exemplary embodiment of the semiconductor light source apparatus will now be described with reference to FIGS. 14 to 15. FIG. 14 is a schematic structural view showing a basic structure including moving directions of light rays of a seventh exemplary embodiment of a semiconductor light source apparatus made in accordance with principles of the disclosed subject matter.

The semiconductor light source apparatus of the seventh embodiment can include: a wavelength converting member 620 that is formed in a basically dome shape; a cavity 624 that is formed in a basically dome shape; a convex surface 423 at the end portion of the cavity 624 in common with the six embodiment; and the LD 30 emitting the laser light toward the convex surface 423 in common with the fifth embodiment.

Accordingly, the phosphor layer 621 can also be formed in a substantially dome shape, and an inner surface of the phosphor layer 621 can form the convex surface 423 which projects toward the cavity 624 near a light-emitting surface of the dome shape. A clad layer 622 can be located adjacent an outer surface of the phosphor layer 621 in an opposite direction of the cavity 624, and can be formed in a ring shape so as to expose the light-emitting surface of the outer surface of the phosphor layer 621 from the clad layer 622.

When the laser light gets to the convex surface 423, which is the inner surface of the convex portion of the phosphor layer 621, most of the laser light can enter into the phosphor layer 621 from the convex portion thereof, and laser light that cannot enter into the phosphor layer 621 can be reflected circumferentially on the convex surface 423. When the reflective light diffused from the convex surface 423 gets to the inner surface of the phosphor layer 621, most of the reflective light can enter into the phosphor layer 621 whenever the reflective light is reflected on the inner surface of the phosphor layer 621.

The semiconductor light source apparatus of the seventh embodiment can emit a wavelength converted light having various wavelengths from the light-emitting surface that is located on the outer surface of the phosphor layer 621 and is exposed from the clad layer 622, by exciting the phosphor material of the phosphor layer 621 using the laser light entering into the phosphor layer 621 as the excitation light, while diffusing light wavelength-converted by the phosphor material and a part of the laser light that is not excited by the phosphor material in the phosphor layer 621 and while repeating the reflections of this light between the clad layer 622 and the inner surface of the phosphor layer 621.

In this case, the semiconductor light source apparatus can also emit the wavelength converting light converged using a lens effect of the phosphor layer 621, which is formed in a dome shape. In addition, the light-emitting surface of the phosphor layer 621 can include at least one of a planar surface, a convex surface and a concave surface, and therefore can be formed in various shapes using the at least one of the planar surface, the convex surface and the concave surface to provide a favorable light distribution in accordance with a usage of the semiconductor light source apparatus.

Thus, the seventh embodiment of the disclosed subject matter can also provide the semiconductor light source apparatus having a high light-emitting efficiency using reflections repeated in the phosphor layer 621, the lens effect of the phosphor layer 621 and various shapes of the light-emitting surface by forming the phosphor layer 621 in a dome shape.

In the seventh embodiment, the clad layer 622 can be formed in a ring shape so as to cover the outer surface of the phosphor layer 621. The clad layer 622 can also extend toward an opening of the cavity 624 so as to cover a bottom surface of the phosphor layer 621 and a part of the opening of the cavity 624 therewith while the clad layer 622 does not shade the laser light that is emitted toward the convex surface 423 from the LD 30 in common with the third and the fourth embodiments.

Thereby, light returning toward the LD 30 from the inner surface of the phosphor layer 621 can be directed toward the inner surface of the phosphor layer 621 including the convex surface 423 by the clad layer 622. Therefore, the seventh embodiment can provide the semiconductor light source apparatus having a higher light-emitting efficiency using the clad layer 622, which extends toward the opening of the cavity 624.

Figure 15:
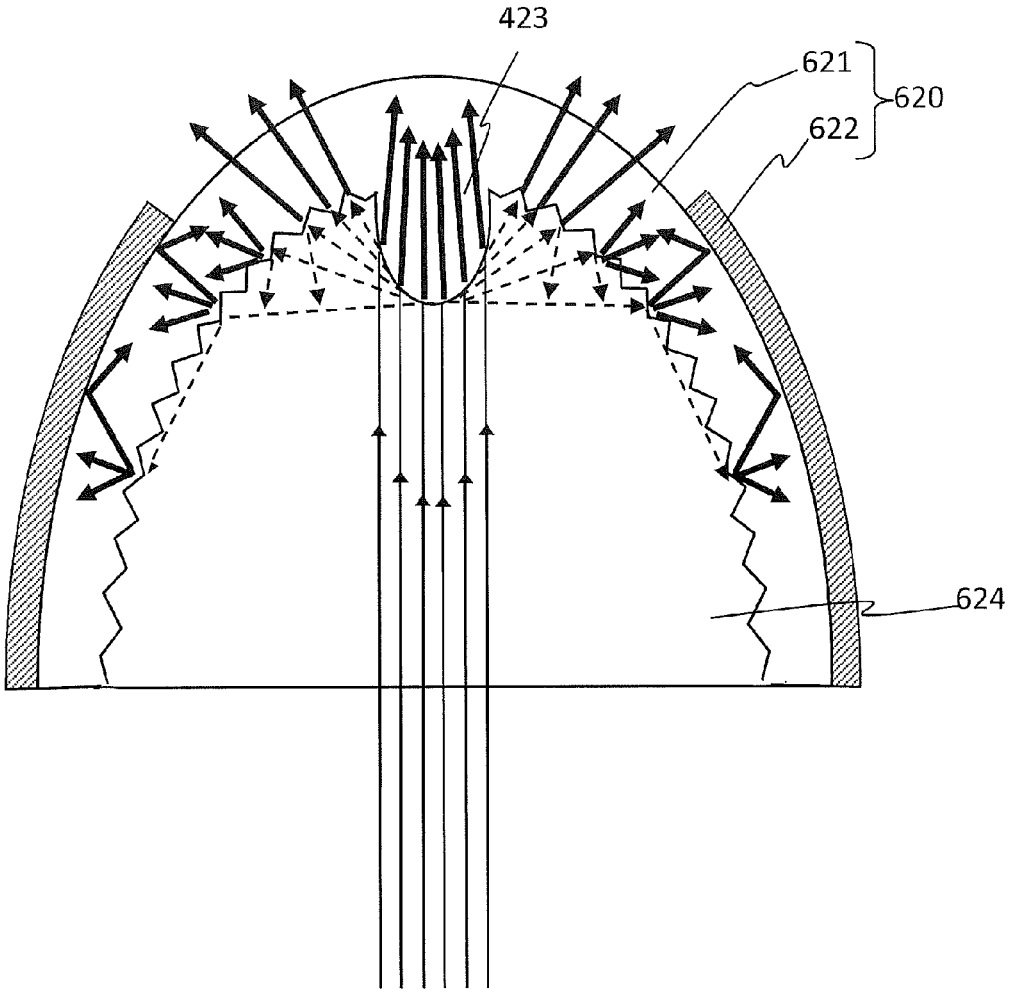
FIG. 15 is a cross-sectional explanatory drawing depicting an exemplary variation of a wavelength converting member of the embodiment shown in FIG. 14.
Figure 16:
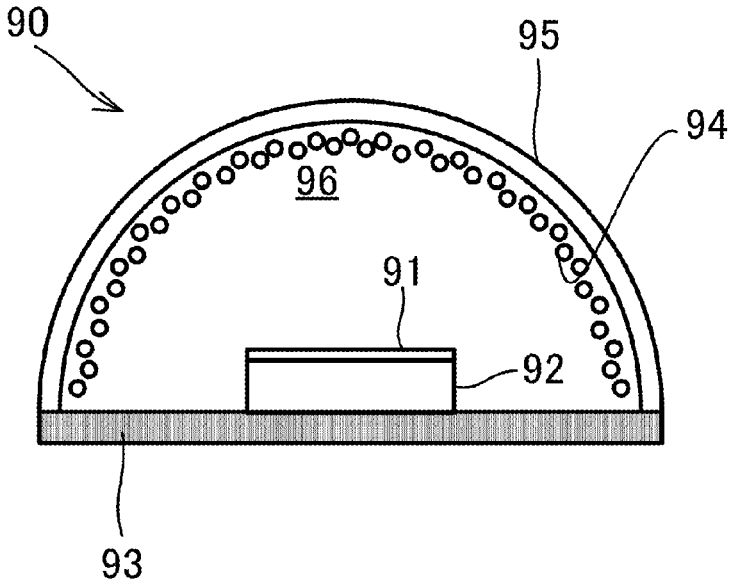
FIG. 16 Conventional Art
FIG. 16 is a schematic cross-sectional view showing a first conventional semiconductor light source apparatus using a phosphor and a laser light.
Figure 17A:
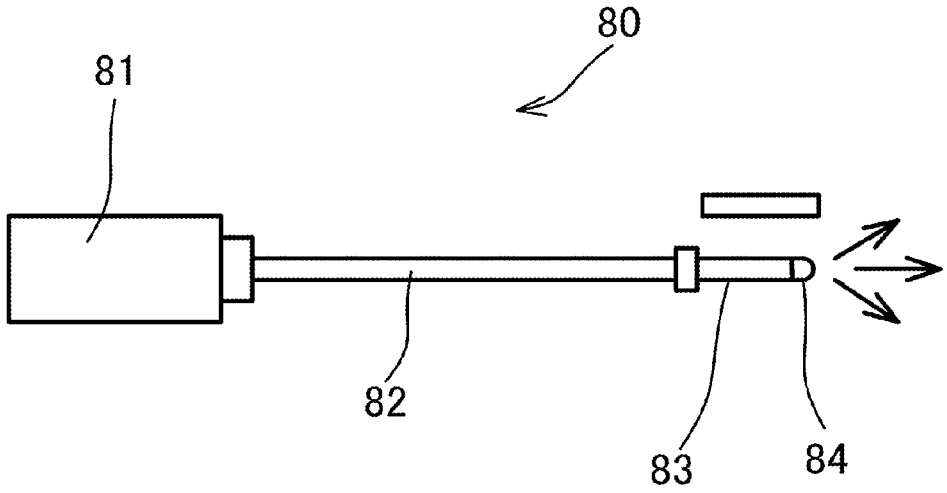
FIG. 17a Conventional Art
FIG. 17*a* is a schematic structural view showing a second conventional semiconductor light source apparatus using a light guide in addition to a laser light and a phosphor.
Figure 17B:
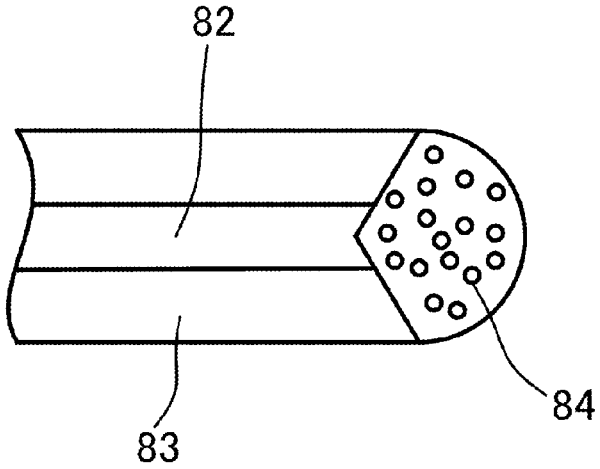
FIG. 17b Conventional Art
FIG. 17*b* is a close up cross-sectional view showing an exemplary light-emitting portion of the semiconductor light source apparatus shown in FIG. 17*a*.
Figure 18:
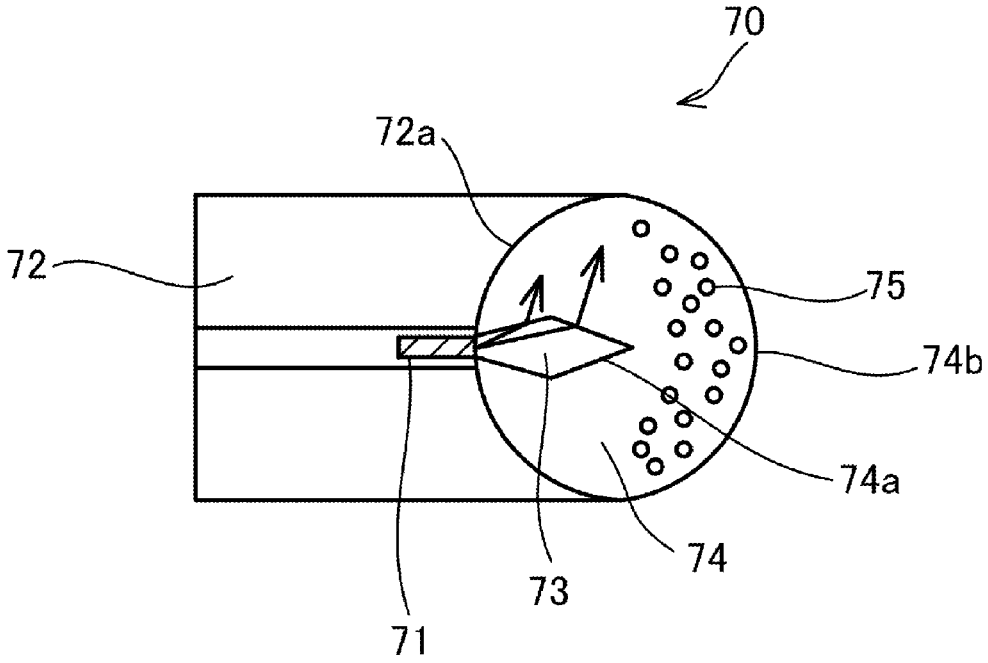
FIG. 18 Conventional Art
FIG. 18 is a schematic horizontal cross-sectional view depicting a third semiconductor light source apparatus using a laser light and a phosphor, in which a reflection ratio of a laser light reduces on a surface of a light guide including a phosphor.

FIG. 15 is a cross-sectional explanatory drawing depicting an exemplary variation of the wavelength converting member 620 in the seventh embodiment. The inner surface of the phosphor layer 621 having the dome shape can be formed with a rough surface, which includes alternately concave and convex surfaces. In this case, an average roughness Ra of the rough surface of the phosphor layer 621 can be between 1.0 a and 50 a. By forming the inner surface of the phosphor layer 621 with such a rough surface, most of the returning light caused by reflecting the laser light toward the LD 30 on the convex surface 423 can move toward the convex surface 423 in the cavity 624 by diffusing the returning light on the rough surface including the alternately concave and convex surfaces.

Thus, the semiconductor light source apparatus, which includes the rough surface on the inner surface of the phosphor layer 621, can also improve a light-emitting efficiency because an amount of the returning light toward the LD 30 can be reduced and an amount of the laser light entering into the phosphor layer 621 can be increased. In the above-described structure, the clad layer 622 can also extend toward the opening of the cavity 624 so as to cover the bottom surface of the phosphor layer 621 and part of the opening of the cavity 624, while the clad layer 622 does not shade the laser light that is emitted toward the convex surface 423 from the LD 30. Thereby, the seventh embodiment can provide the semiconductor light source apparatus having a higher light-emitting efficiency using the clad layer 622, which extends toward the opening of the cavity 624.

As described above, because the laser light entering into the cavity can repeat reflections on the inner surface of the phosphor layer many times, each and every time most of the laser light can enter into the phosphor layer having the above-described structures, a back-reflection toward the laser diode can be prevented. In addition, the light-emitting surface can be formed in various outer shapes by varying a shape of the clad layer, which can expose the light-emitting surface of the semiconductor light source apparatus using the clad layer, and also can be formed in various lens surfaces using at least one of the planar surface, the convex surface and the concave surface. Thus, the disclosed subject matter can provide semiconductor light source apparatuses which can emit a natural light having a high light-emitting efficiency and a high light-emitting density such that can be used as a light source for a vehicle headlight, a projector, etc.

Moreover, for example, when the laser diode emits the ultraviolet light and when the phosphor layer includes a red phosphor, a green phosphor and a blue phosphor as the at least one phosphor material, the semiconductor light source apparatus can emit various color lights in accordance with each density of respective phosphors included in the phosphor layer. Thus, the disclosed subject matter can also provide semiconductor light source apparatuses having a high light intensity and a high light-emitting efficiency, which can provide various light distribution patterns having various color tones and which can be used for various lighting units such as general lighting, a street light, a stage light, etc., as well as vehicular applications.

Various modifications of the above disclosed embodiments can be made without departing from the spirit and scope of the presently disclosed subject matter. For example, cases where the light-emitting surface of the top surface of the phosphor layer is formed in a substantially circular shape are described. However, the light-emitting surface is not limited to this shape and can be formed in various shapes such as an ellipsoidal shape and the like. In addition, the specific arrangement between components can vary between different applications, and several of the above-described features can be used interchangeably between various embodiments depending on a particular application of the device.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A semiconductor light source apparatus, comprising:

a phosphor layer having a top surface, a bottom surface, an inner surface, an outer surface, a cavity, a top edge located between the top surface and the outer surface and a bottom edge located between the bottom surface and the outer surface, and including at least one phosphor material, the at least one phosphor material configured to convert at least one energy of blue light and ultraviolet light into light having a wavelength, the top surface including at least one of a planar surface, a convex surface and a concave surface, the bottom surface having a ring shape, the cavity defined at least in part by the inner surface of the phosphor layer, an opening surrounded by the bottom surface and an end of the cavity located opposite the opening, and the cavity configured to narrow from the opening toward the end of the cavity;

a clad layer having a first opening, a second opening and an inner surface, and configured in a ring shape, the inner surface of the clad layer including a reflective material and being located adjacent the outer surface of the phosphor layer, the first opening of the clad layer located adjacent the top edge of the phosphor layer, and the second opening of the clad layer located adjacent the bottom edge of the phosphor layer; and a semiconductor laser diode having an optical axis and configured to emit a laser light including at least one of a blue light and an ultraviolet light when the semiconductor laser diode operates, the optical axis of the semiconductor laser diode intersecting with the inner surface of the phosphor layer at an intersection location so that a first portion of the laser light enters into the phosphor layer at the intersection location and a second portion of the laser light is reflected by the inner surface of the phosphor layer, wherein the inner surface of the phosphor layer is configured to again receive and allow entry of at least a part of the second portion of the laser light at a location closer to the end of the cavity in the phosphor layer than the intersection location.

2. The semiconductor light source apparatus according to claim 1, wherein each of the top edge and the bottom edge of the phosphor layer is a substantially same shape and each shape having a central point, and the outer surface of the phosphor layer is substantially parallel to a central axis connecting the central point of the top edge to the central point of the bottom edge of the phosphor layer.

3. The semiconductor light source apparatus according to claim 1, wherein each of the top edge and the bottom edge of the phosphor layer is formed in a substantially similar shape and each shape having a central point, and the similar shape shrinks from the bottom edge of the phosphor layer toward the top edge of the phosphor along a central axis connecting the central point of the top edge to the central point of the bottom edge of the phosphor layer.

4. The semiconductor light source apparatus according to claim 1, wherein the cavity of the phosphor layer is formed in a conical shape in which the opening of the cavity is defined as a base of the conical shape and the end of the cavity is defined as a vertex of the conical shape.

5. The semiconductor light source apparatus according to claim 2, wherein the cavity of the phosphor layer is formed in a conical shape having a central axis, in which the opening of the cavity is defined as a base of the conical shape, the end of the cavity is defined as a vertex of the conical shape, and the central axis of the conical shape coincides with the central axis connecting the central point of the top edge to the central point of the bottom edge of the phosphor layer.

6. The semiconductor light source apparatus according to claim 3, wherein the cavity of the phosphor layer is formed in a conical shape having a central axis, in which the opening of the cavity is defined as a base of the conical shape, the end of the cavity is defined as a vertex of the conical shape, and the central axis of the conical shape coincides with the central axis connecting the central point of the top edge to the central point of the bottom edge of the phosphor layer.

7. The semiconductor light source apparatus according to claim 1, wherein the cavity of the phosphor layer is formed in a bullet shape, in which the opening of the cavity is defined as a base of the bullet shape and the end of the cavity is defined as a vertex of the bullet shape.

8. The semiconductor light source apparatus according to claim 1, wherein the cavity of the phosphor layer is formed in a tapered cylinder shape such that the cavity is defined by a diagonal cut in a cylinder from a top edge to a halfway point located on an opposite side of the top edge, in which the opening of the cavity is defined as a base of the tapered cylinder shape and the end of the cavity is defined as a vertex of the tapered cylinder shape.

9. The semiconductor light source apparatus according to claim 1, wherein the clad layer extends toward the opening of the cavity in a range such that the clad layer does not shade the laser light emitted from the semiconductor laser diode.

10. A semiconductor light source apparatus, comprising:

a phosphor layer having a top surface, a bottom edge, an inner surface, an outer surface, a cavity and a top edge located between the top surface and the outer surface, and including at least one phosphor material, the at least one phosphor material configured to convert at least one energy of blue light and ultraviolet light into light having a wavelength, the top surface including at least one of a planar surface, a convex surface and a concave surface, the bottom edge having a ring shape and being located between the outer surface and the inner surface of the phosphor layer, the cavity being defined by the inner surface of the phosphor layer, an opening surrounded by the bottom edge and a convex surface located opposite the opening, the convex surface having a top end and a central axis formed in a rotational plane with respect to the central axis and connecting to the inner surface of the phosphor layer, and therefore the inner surface of the phosphor layer forming the convex surface in the cavity, and the phosphor layer configured such that the cavity narrows from the opening toward the top end of the convex surface along the central axis of the convex surface;

a clad layer having a first opening, a second opening and an inner surface, and having a ring shape, the inner surface of the clad layer including a reflective material and being located adjacent the outer surface of the phosphor layer, the first opening of the clad layer located adjacent the top edge of the phosphor layer, and the second opening of the clad layer located adjacent the bottom edge of the phosphor layer; and a semiconductor laser diode having an optical axis configured to emit laser light, including at least one of a blue light and an ultraviolet light, toward the convex surface when the semiconductor laser diode operates, the optical axis of the semiconductor laser diode corresponding to the central axis of the convex surface in the cavity of the phosphor layer so that the laser light enters into the phosphor layer from the convex surface, wherein the convex surface is configured to diffuse another portion of the laser light not entering into the phosphor layer from the convex surface.

11. The semiconductor light source apparatus according to claim 10, wherein the phosphor layer further includes a plurality of convex portions located on the inner surface of the phosphor layer near the convex surface so as to project in a direction of the central axis of the convex surface and side by side in an extending direction of the clad layer, and each of the convex portions includes a planar surface extending in a direction substantially perpendicular to the central axis of the convex surface and an inclined surface inclined in a direction toward the opening of the cavity.

12. The semiconductor light source apparatus according to claim 10, wherein the inner surface of the phosphor layer includes a rough surface, in which an average roughness Ra of the rough surface of the phosphor layer is between 1.0 a and 50 a.

13. The semiconductor light source apparatus according to claim 10, wherein the clad layer extends over the opening of the cavity in a range that does not shade the laser light emitted from the semiconductor laser diode.

14. The semiconductor light source apparatus according to claim 11, wherein the clad layer extends toward the opening of the cavity in a range that does not shade the laser light emitted from the semiconductor laser diode.

15. The semiconductor light source apparatus according to claim 12, wherein the clad layer extends toward the opening of the cavity in a range that does not shade the laser light emitted from the semiconductor laser diode.

16. A semiconductor light source apparatus, comprising:

a phosphor layer having an outer surface, an inner surface, a bottom surface and a cavity, the phosphor layer being formed in a dome shape, and the phosphor layer including at least one phosphor material, the at least one phosphor material configured to convert at least one energy of blue light and ultraviolet light into light having a wavelength, the outer surface including a light-emitting surface, the light-emitting surface of the outer surface including at least one of a planar surface, a convex surface and a concave surface, the bottom surface formed in a ring shape and being located between the outer surface and the inner surface of the phosphor layer, the cavity being defined by the inner surface of the phosphor layer that is formed in a dome shape, an opening surrounded by the bottom surface and a convex surface located opposite the opening, the convex surface having a top end and a central axis formed in a rotational plane with respect to the central axis and connecting to the inner surface of the phosphor layer, and therefore the inner surface of the phosphor layer forming the convex surface in the cavity;

a clad layer having a first opening, a second opening and an inner surface, and formed in a ring shape, the inner surface of the clad layer including a reflective material and being located adjacent the outer surface of the phosphor layer, the first opening of the clad layer exposing the light-emitting surface of the phosphor layer from the outer surface of the phosphor layer, and the second opening of the clad layer located adjacent the bottom surface of the phosphor layer; and a semiconductor laser diode having an optical axis and configured to emit a laser light, including at least one of a blue light and an ultraviolet light, toward the convex surface in the cavity when the semiconductor laser diode operates, the optical axis of the semiconductor laser diode corresponding to the central axis of the convex surface in the cavity of the phosphor layer so that at least a portion of the laser light enters into the phosphor layer from the convex surface, wherein the convex surface in the cavity of the phosphor layer is configured to diffuse another portion of the laser light not entering into the phosphor layer from the convex surface.

17. The semiconductor light source apparatus according to claim 16, wherein the inner surface of the phosphor layer includes a rough surface, in which an average roughness Ra of the rough surface of the phosphor layer is between 1.0 a and 50 a.

18. The semiconductor light source apparatus according to 16, wherein the clad layer extends over the opening of the cavity in a range that does not shade the laser light emitted from the semiconductor laser diode.

19. The semiconductor light source apparatus according to claim 1, wherein the semiconductor laser diode is a blue light-emitting device and the phosphor layer is one of a yellow glass phosphor layer and a yellow phosphor ceramic.

20. The semiconductor light source apparatus according to claim 2, further comprising:

an optical lens having an optical axis and being located adjacent the top surface of the phosphor layer, wherein the optical axis of the optical lens coincides with the central axis connecting the central point of the top edge to the central point of the bottom edge of the phosphor layer.

* * * * *